US012071294B2

(12) United States Patent
Kamigaki et al.

(10) Patent No.: US 12,071,294 B2
(45) Date of Patent: Aug. 27, 2024

(54) CUSHIONING MATERIAL, PACKING MATERIAL, AND PACKED GOODS

(71) Applicant: SEIKO EPSON CORPORATION, Tokyo (JP)

(72) Inventors: Shinya Kamigaki, Shiojiri (JP); Ippo Hashimoto, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 11 days.

(21) Appl. No.: 18/049,388

(22) Filed: Oct. 25, 2022

(65) Prior Publication Data

US 2023/0131323 A1 Apr. 27, 2023

(30) Foreign Application Priority Data

Oct. 27, 2021 (JP) ..... 2021-175297

(51) Int. Cl.
*B65D 81/05* (2006.01)
*B65D 77/26* (2006.01)

(52) U.S. Cl.
CPC ..... *B65D 81/057* (2013.01); *B65D 77/26* (2013.01); *B65D 2581/051* (2013.01)

(58) Field of Classification Search
CPC ..... B65D 81/057; B65D 81/102; B65D 2581/051; B65D 2581/052; B65D 2585/86

(Continued)

(56) References Cited

U.S. PATENT DOCUMENTS 3,356,209 A * 12/1967 Pezely, Jr. ..... B65D 81/107 206/523
3,399,797 A * 9/1968 Freeman ..... B65D 81/107 220/920

(Continued)

FOREIGN PATENT DOCUMENTS

JP 2015-209229 A 11/2015

*Primary Examiner* — Luan K Bui
(74) *Attorney, Agent, or Firm* — WORKMAN NYDEGGER

(57) ABSTRACT

Provided is a cushioning material for being put into a packing box configured for encasement of electronic equipment. The cushioning material absorbs external stress applied to the electronic equipment encased in the packing box. The cushioning material includes: a holder including a first plate having a first opening and configured to face the electronic equipment, and a second plate having a second opening and configured to face an inner wall surface of the packing box; and a first cushioning block held by the holder between the first plate and the second plate. The first cushioning block includes a first cushioning portion protruding through the first opening in a first direction going from the first plate toward the electronic equipment and configured to be in contact with the electronic equipment, a second cushioning portion protruding through the second opening in a second direction going from the second plate toward the inner wall surface of the packing box and configured to be in contact with the inner wall surface of the packing box, and a first link portion provided between the first plate and the second plate and linking the first cushioning portion and the second cushioning portion to each other. The first link portion is longer than the first opening and the second opening in a first holding direction intersecting with the first direction and the second direction.

6 Claims, 9 Drawing Sheets

(58) Field of Classification Search
USPC ..... 206/320, 453, 523, 586, 591–594
See application file for complete search history.

(56) References Cited

U.S. PATENT DOCUMENTS

| | | | | | |
|---|---|---|---|---|---|
| 4,287,265 | A * | 9/1981 | McKnight | B65D 81/056 | 267/141.1 |
| 4,880,214 | A * | 11/1989 | Sukai | B65D 81/05 | 403/194 |
| 5,755,331 | A * | 5/1998 | Watson | B65D 81/05 | 206/320 |
| 5,772,025 | A * | 6/1998 | Chen | B65D 81/05 | 206/320 |
| 6,092,651 | A * | 7/2000 | Miller | B65D 81/113 | 206/521 |
| 7,591,373 | B2 * | 9/2009 | Horiuchi | B65D 5/5035 | 53/445 |
| 2013/0233754 | A1 * | 9/2013 | Liu | B65D 81/057 | 206/521 |

* cited by examiner

CUSHIONING MATERIAL, PACKING MATERIAL, AND PACKED GOODS

The present application is based on, and claims priority from JP Application Serial Number 2021-175297, filed Oct. 27, 2021, the disclosure of which is hereby incorporated by reference herein in its entirety.

BACKGROUND

1. Technical Field

The present disclosure relates to a cushioning material, a packing material, and packed goods.

2. Related Art

A cushioning material for being put into a packing box configured for encasement of electronic equipment so as to absorb external stress applied to the electronic equipment is known. For example, JP-A-2015-209229 discloses a technique for holding a lower-end corner of electronic equipment by means of a cushioning material formed by mating two cushioning members together.

However, in the related art, the two cushioning members constituting the cushioning material could become separated from each other when the cushioning material is under external stress. The separation of the two cushioning members constituting the cushioning material from each other and resultant breakup of the cushioning material could increase the risk of failure to protect the electronic equipment by means of the cushioning material.

SUMMARY

Provided by a certain aspect of the present disclosure is a cushioning material for being put into a packing box configured for encasement of electronic equipment, the cushioning material being configured to absorb external stress applied to the electronic equipment encased in the packing box, the cushioning material comprising: a holder including a first plate having a first opening and configured to face the electronic equipment when the cushioning material and the electronic equipment are encased in the packing box, and a second plate having a second opening and configured to face an inner wall surface of the packing box when the cushioning material and the electronic equipment are encased in the packing box; and a first cushioning block held by the holder between the first plate and the second plate, the first cushioning block including a first cushioning portion protruding through the first opening in a first direction going from the first plate toward the electronic equipment and configured to be in contact with the electronic equipment, a second cushioning portion protruding through the second opening in a second direction going from the second plate toward the inner wall surface of the packing box and configured to be in contact with the inner wall surface of the packing box, and a first link portion provided between the first plate and the second plate and linking the first cushioning portion and the second cushioning portion to each other, wherein the first link portion is longer than the first opening and the second opening in a first holding direction intersecting with the first direction and the second direction.

Also provided by a certain aspect of the present disclosure is a packing material, comprising: a packing box configured for encasement of electronic equipment; and a cushioning material configured to absorb external stress applied to the electronic equipment encased in the packing box, the cushioning material including a holder including a first plate having a first opening and configured to face the electronic equipment when the cushioning material and the electronic equipment are encased in the packing box, and a second plate having a second opening and configured to face an inner wall surface of the packing box when the cushioning material and the electronic equipment are encased in the packing box, and a first cushioning block held by the holder between the first plate and the second plate, the first cushioning block including a first cushioning portion protruding through the first opening in a first direction going from the first plate toward the electronic equipment and configured to be in contact with the electronic equipment, a second cushioning portion protruding through the second opening in a second direction going from the second plate toward the inner wall surface of the packing box and configured to be in contact with the inner wall surface of the packing box, and a first link portion provided between the first plate and the second plate and linking the first cushioning portion and the second cushioning portion to each other, wherein the first link portion is longer than the first opening and the second opening in a first holding direction intersecting with the first direction and the second direction.

Also provided by a certain aspect of the present disclosure is packed goods, comprising: electronic equipment; a packing box configured for encasement of the electronic equipment; and a cushioning material configured to absorb external stress applied to the electronic equipment encased in the packing box, the cushioning material including a holder including a first plate having a first opening and configured to face the electronic equipment when the cushioning material and the electronic equipment are encased in the packing box, and a second plate having a second opening and configured to face an inner wall surface of the packing box when the cushioning material and the electronic equipment are encased in the packing box, and a first cushioning block held by the holder between the first plate and the second plate, the first cushioning block including a first cushioning portion protruding through the first opening in a first direction going from the first plate toward the electronic equipment and configured to be in contact with the electronic equipment, a second cushioning portion protruding through the second opening in a second direction going from the second plate toward the inner wall surface of the packing box and configured to be in contact with the inner wall surface of the packing box, and a first link portion provided between the first plate and the second plate and linking the first cushioning portion and the second cushioning portion to each other, wherein the first link portion is longer than the first opening and the second opening in a first holding direction intersecting with the first direction and the second direction.

DESCRIPTION OF EXEMPLARY EMBODIMENTS

Figure 1:
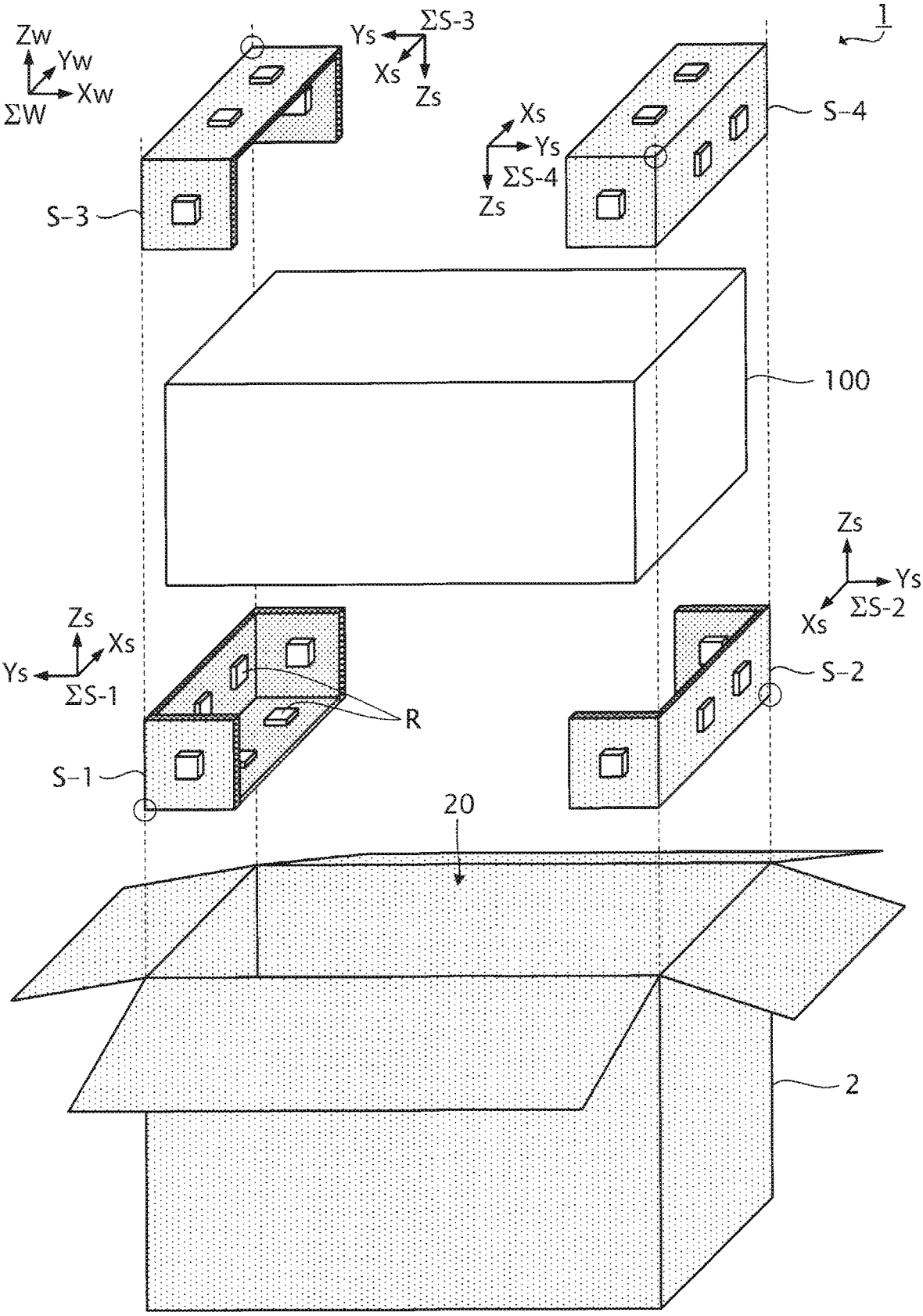
FIG. 1 is an exploded perspective view illustrating an example of a structure of a packing material according to a first embodiment of the present disclosure.

With reference to the accompanying drawings, some exemplary embodiments of the present disclosure will now be explained. In the drawings, the dimensions and scales of components may be made different from those in actual implementation. Since the embodiments described below show some preferred examples of the present disclosure, they contain various technically-preferred limitations. However, the scope of the present disclosure shall not be construed to be limited to the examples described below unless and except where the description contains an explicit mention of an intent to limit the present disclosure.

1. First Embodiment

A first embodiment of the present disclosure will now be explained.

1.1. Overall Overview of Packed Goods

With reference to FIG. 1, an example of a structure of a packing material 1 according to a present embodiment will now be explained.

FIG. 1 is an exploded perspective view illustrating an example of a structure of a packing material 1.

As illustrated in FIG. 1, the packing material 1 is used for encasement of electronic equipment 100. Specifically, the packing material 1 includes a packing box 2 configured for encasement of the electronic equipment 100, and includes plural pieces of cushioning material S configured to absorb external stress applied to the electronic equipment 100 encased in the packing box 2.

One example of the electronic equipment 100 is a printing apparatus such as an ink-jet printer. However, the electronic equipment 100 according to the present embodiment is not limited thereto. It may be any equipment other than a printing apparatus, for example, a television set, a refrigerator, a washing machine, a microwave, a personal computer, or the like.

A collective term "packed goods" may be hereinafter used for collectively referring to, together with the packing material 1, the electronic equipment 100 that is in an encased state by being packed using the packing material 1.

As illustrated in FIG. 1, in the present embodiment, it is assumed that the packing material 1 includes four pieces of cushioning material S-1 to S-4. In the present embodiment, the electronic equipment 100 and the four pieces of cushioning material S-1 to S-4 are put into the packing box 2 through an opening 20 of the packing box 2, thereby becoming encased in the packing box 2.

For easier understanding, the description below will be given with reference to a packing box coordinate system ΣW fixed to the packing box 2. The packing box coordinate system ΣW introduced herein is a triaxial coordinate system that includes a Zw axis, which extends in a +Zw direction, an Xw axis, which extends in an +Xw direction orthogonal to the +Zw direction, and a Yw axis, which extends in a +Yw direction orthogonal to the +Zw direction and the +Xw direction. The +Zw direction is a direction from the bottom of the packing box 2 toward its opening 20. In the description below, the direction that is the opposite of the +Xw direction will be referred to as "−Xw direction", the direction that is the opposite of the +Yw direction will be referred to as "−Yw direction", and the direction that is the opposite of the +Zw direction will be referred to as "−Zw direction".

The description below will be given also with reference to a cushioning material coordinate system ΣS fixed to the cushioning material S. The cushioning material coordinate system ΣS introduced herein is a triaxial coordinate system that includes a Zs axis, which extends in a +Zs direction, an Xs axis, which extends in an +Xs direction orthogonal to the +Zs direction, and a Ys axis, which extends in a +Ys direction orthogonal to the +Zs direction and the +Xs direction. In the description below, the direction that is the opposite of the +Xs direction will be referred to as "−Xs direction", the direction that is the opposite of the +Ys direction will be referred to as "−Ys direction", and the direction that is the opposite of the +Zs direction will be referred to as "−Zs direction".

As illustrated in FIG. 1, the cushioning material S-1 is a cushioning material S that supports a lower edge portion of the electronic equipment 100 at a position on the −Zw side of the electronic equipment 100 and on the −Xw side of the electronic equipment 100 when the electronic equipment 100 and the four pieces of cushioning material S-1 to S-4 are encased in the packing box 2. The cushioning material coordinate system ΣS-1 fixed to the cushioning material S-1 is provided such that the +Zs direction is in line with the +Zw direction, the +Xs direction is in line with the +Yw direction, and the +Ys direction is in line with the −Xw direction.

The cushioning material S-2 is a cushioning material S that supports a lower edge portion of the electronic equipment 100 at a position on the −Zw side of the electronic equipment 100 and on the +Xw side of the electronic equipment 100 when the electronic equipment 100 and the four pieces of cushioning material S-1 to S-4 are encased in the packing box 2. The cushioning material coordinate system ΣS-2 fixed to the cushioning material S-2 is provided such that the +Zs direction is in line with the +Zw direction, the +Xs direction is in line with the −Yw direction, and the +Ys direction is in line with the +Xw direction.

The cushioning material S-3 is a cushioning material S that supports an upper edge portion of the electronic equipment 100 at a position on the +Zw side of the electronic equipment 100 and on the −Xw side of the electronic equipment 100 when the electronic equipment 100 and the four pieces of cushioning material S-1 to S-4 are encased in the packing box 2. The cushioning material coordinate system ΣS-3 fixed to the cushioning material S-3 is provided such that the +Zs direction is in line with the −Zw direction, the +Xs direction is in line with the −Yw direction, and the +Ys direction is in line with the −Xw direction.

The cushioning material S-4 is a cushioning material S that supports an upper edge portion of the electronic equipment 100 at a position on the +Zw side of the electronic equipment 100 and on the +Xw side of the electronic equipment 100 when the electronic equipment 100 and the four pieces of cushioning material S-1 to S-4 are encased in the packing box 2. The cushioning material coordinate system ΣS-4 fixed to the cushioning material S-4 is provided such that the +Zs direction is in line with the −Zw direction, the +Xs direction is in line with the +Yw direction, and the +Ys direction is in line with the +Xw direction.

1.2. Overview of Cushioning Material

Next, with reference to FIGS. 2 and 3, an example of a structure of the cushioning material S according to the present embodiment will now be explained.

Figure 2:
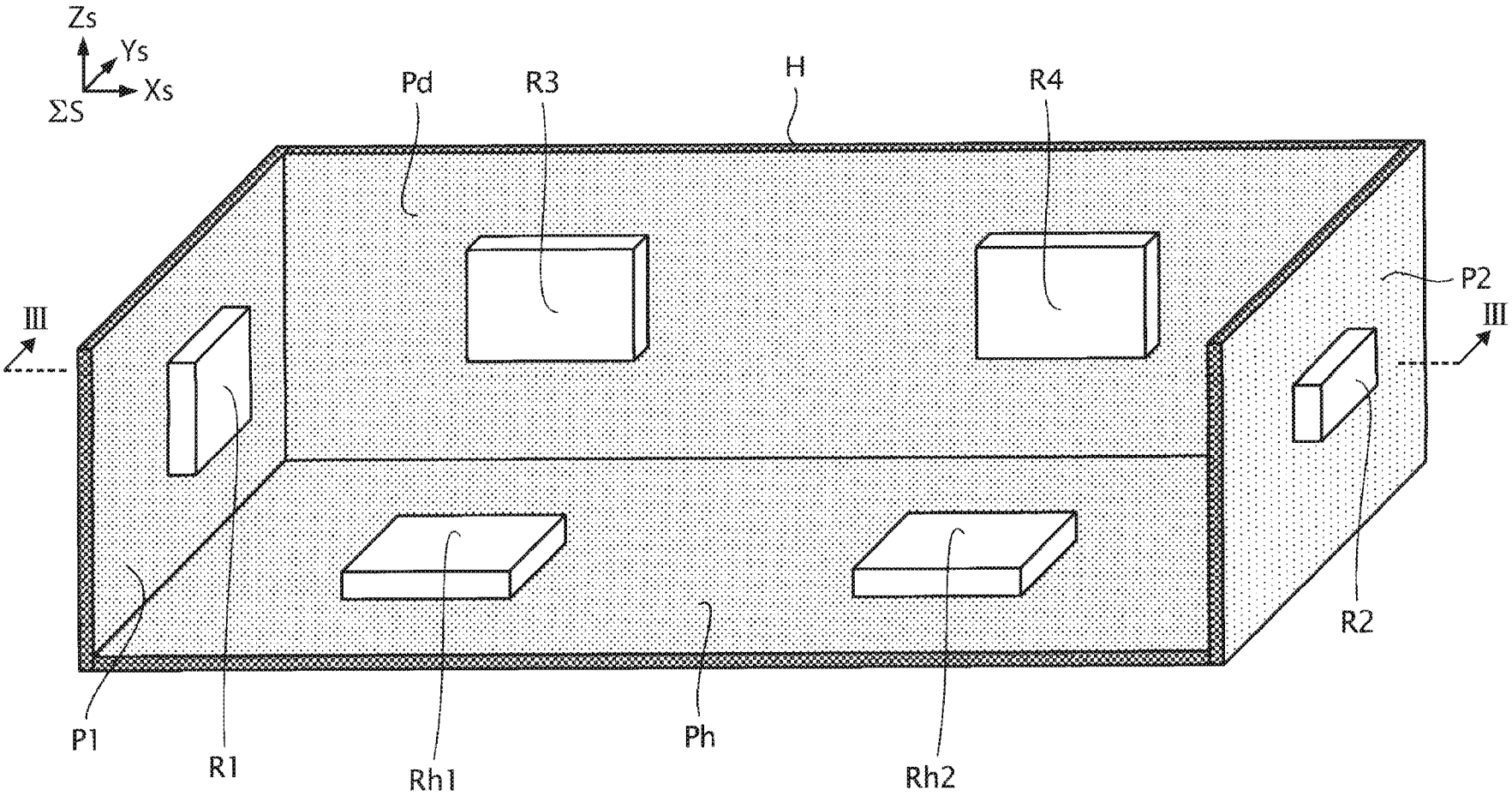
FIG. 2 is a perspective view illustrating an example of a structure of a cushioning material S.

FIG. 2 is a perspective view illustrating an example of a structure of the cushioning material S.

As illustrated in FIG. 2, the cushioning material S includes a plurality of cushioning blocks R for absorbing external stress applied to the electronic equipment 100 and a holder H for holding each of the plurality of cushioning blocks R.

The holder H has a plate portion P1 constituting the −Xs-side sidewall of the cushioning material S, a plate portion P2 constituting the +Xs-side sidewall of the cushioning material S, a plate portion Pd constituting the back of the cushioning material S, and a plate portion Ph constituting the bottom of the cushioning material S. More specifically, the plate portion P1 is a side portion of the cushioning material S at the −Xs-side end of the cushioning material S, and a line normal to this portion goes in a direction along the +Xs direction. The plate portion P2 is a side portion of the cushioning material S at the +Xs-side end of the cushioning material S, and a line normal to this portion goes in a direction along the +Xs direction. The plate portion Pd is the rear portion of the cushioning material S at the +Ys-side end of the cushioning material S, and a line normal to this portion goes in a direction along the +Ys direction. The plate portion Ph is the bottom portion of the cushioning material S at the −Zs-side end of the cushioning material S, and a line normal to this portion goes in a direction along the +Zs direction. The plate portion P1, the plate portion P2, the plate portion Pd, and the plate portion Ph may be hereinafter collectively referred to as "plate portion P".

In the present embodiment, a case where each of the plurality of plate portions P constituting the holder H is made of corrugated cardboard is assumed as an example.

As illustrated in FIG. 2, in the present embodiment, it is assumed that the cushioning material S has six cushioning blocks R, which are: a cushioning block R1 held by the plate portion P1, a cushioning block R2 held by the plate portion P2, cushioning blocks R3 and R4 held by the plate portion Pd, and cushioning blocks Rh1 and Rh2 held by the plate portion Ph. The cushioning block R4 is a cushioning block R located on the +Xs side with respect to the cushioning block R3. The cushioning block Rh2 is a cushioning block R located on the +Xs side with respect to the cushioning block Rh1.

In the present embodiment, it is assumed that the cushioning block R is made of a material having lower elasticity than styrene foam.

In the present embodiment, the following case is assumed as an example: fibers contained in a matter/material are obtained by defibrating the matter/material such as paper, clothes, or the like containing various kinds of fibers such as animal-based fibers, plant-based fibers, chemical fibers, or the like, and then the obtained fibers are processed, thereby forming the cushioning blocks R. More specifically, in the present embodiment, it is assumed that fibers contained in paper are obtained by defibrating the paper, and then the obtained fibers are hardened, thereby forming the cushioning blocks R.

As described above, in the present embodiment, the cushioning blocks R are produced by going through a process of obtaining fibers from a fiber-containing matter/material such as paper, clothes, or the like. That is, in the present embodiment, when a fiber-containing matter/material such as paper, clothes, or the like is thrown away, it is possible to produce the cushioning blocks R by recycling this matter/material. Therefore, the scheme of the present embodiment makes it possible to reduce environmental burdens pertinent to production and disposal of the cushioning blocks R.

Figure 3:
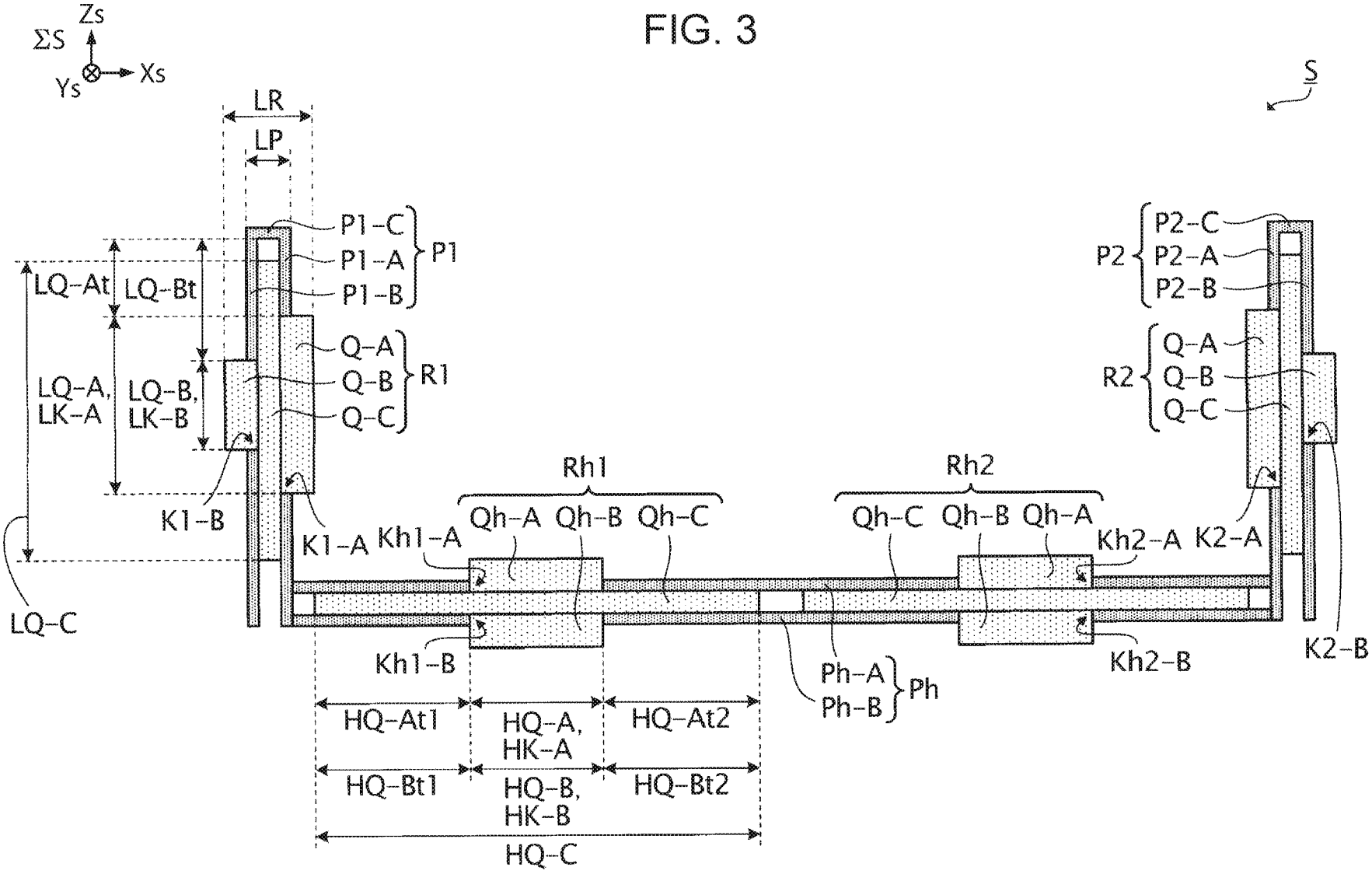
FIG. 3 is a cross-sectional view illustrating an example of a structure of the cushioning material S.

FIG. 3 is a cross-sectional view illustrating an example of a cross section of the cushioning material S taken along the line III-III of FIG. 2.

As illustrated in FIG. 3, the plate portion P1, which is a side portion of the cushioning material S at the −Xs-side end thereof, includes a plate member P1-A, a plate member P1-B, and a plate member P1-C.

Among them, the plate member P1-A is a flat-plate-like member located at the +Xs-side end of the plate portion P1, and a line normal to this member goes in a direction along the +Xs direction. When the cushioning material S and the electronic equipment 100 are encased in the packing box 2, the plate member P1-A faces the electronic equipment 100. The plate member P1-A has an opening K1-A. In the present embodiment, the plate member P1-A is an example of "first plate", and the opening K1-A is an example of "first opening".

The plate member P1-B is a flat-plate-like member located at the −Xs-side end of the plate portion P1, and a line normal to this member goes in a direction along the +Xs direction. When the cushioning material S and the electronic equipment 100 are encased in the packing box 2, the plate member P1-B faces the packing box 2. The plate member P1-B has an opening K1-B. In the present embodiment, the plate member P1-B is an example of "second plate", and the opening K1-B is an example of "second opening".

The plate member P1-C is a flat-plate-like portion located at the +Zs-side end of the plate portion P1, and a line normal to this portion goes in a direction along the +Zs direction. The plate member P1-C links the plate member P1-A and the plate member P1-B to each other. In the present embodiment, the plate member P1-C is an example of "first link plate"

As illustrated in FIG. 3, the cushioning block R1 is held by the plate portion P1 between the plate member P1-A and the plate member P1-B. Specifically, the cushioning block R1 has a cushioning portion Q-A, which protrudes in the +Xs direction through the opening K1-A formed in the plate member P1-A, a cushioning portion Q-B, which protrudes in the −Xs direction through the opening K1-B formed in the plate member P1-B, and a link portion Q-C, which is provided between the plate member P1-A and the plate member P1-B and links the cushioning portion Q-A and the cushioning portion Q-B to each other. In the present embodiment, the cushioning block R1 is an example of "first cushioning block", the cushioning portion Q-A is an example of "first cushioning portion", the cushioning portion Q-B is an example of "second cushioning portion", and the link portion Q-C is an example of "first link portion". In the present embodiment, the +Xs direction is an example of "first direction", the −Xs direction is an example of "second direction", and the +Zs direction is an example of "first holding direction".

In the description below, the length of the cushioning portion Q-A in the +Zs direction will be denoted as LQ-A, the length of the cushioning portion Q-B in the +Zs direction will be denoted as LQ-B, and the length of the link portion Q-C in the +Zs direction will be denoted as LQ-C. In addition, in the description below, the length of the opening K1-A in the +Zs direction will be denoted as LK-A, and the length of the opening K1-B in the +Zs direction will be denoted as LK-B. In addition, in the description below, the length from the plate member P1-C to the cushioning portion Q-A in the +Zs direction will be denoted as LQ-At, and the length from the plate member P1-C to the cushioning portion Q-B in the +Zs direction will be denoted as LQ-Bt.

In the present embodiment, the length LQ-A is assumed to be substantially the same as the length LK-A. In addition, in the present embodiment, the length LQ-B is assumed to be substantially the same as the length LK-B. The concept of "substantially the same" as mentioned herein includes not only a case of being perfectly the same but also a case of being able to be deemed as the same if a margin of error of approximately 5% or less is ignored, a case of being designed to be the same with a tolerable manufacturing error, and the like.

In the present embodiment, the length LQ-C is greater than the length LK-A, and the length LQ-C is greater than the length LK-B. That is, in the present embodiment, the link portion Q-C is longer than the opening K1-A in the +Zs direction, and the link portion Q-C is longer than the opening K1-B in the +Zs direction. Because of this structure, in the present embodiment, it is possible to prevent the cushioning block R1 from coming off through the opening K1-A in the +Xs direction, and to prevent the cushioning block R1 from coming off through the opening K1-B in the −Xs direction. In the present embodiment, it is assumed that the cushioning block R1 is held by the plate portion P1 without using any adhesive. However, the scope of the present disclosure is not limited to such an exemplary structure. The cushioning block R1 may be fixed to the plate portion P1 by means of an adhesive.

In the description below, the length of the cushioning block R1 in the +Xs direction will be denoted as LR, and the length of the plate member P1-C in the +Xs direction will be denoted as LP.

In the present embodiment, the length LR is greater than the length LP. That is, in the present embodiment, the cushioning block R1 is longer than the plate member P1-C in the +Xs direction. Therefore, in the present embodiment, even if external stress is applied to the packing box 2, it is possible to absorb the external stress by the cushioning block R1, thereby softening the external force transmitted to the electronic equipment 100.

As illustrated in FIG. 3, the plate portion P2, which is a side portion of the cushioning material S at the +Xs-side end thereof, includes a plate member P2-A, a plate member P2-B, and a plate member P2-C.

Among them, the plate member P2-A is a flat-plate-like member located at the −Xs-side end of the plate portion P2, and a line normal to this member goes in a direction along the +Xs direction. When the cushioning material S and the electronic equipment 100 are encased in the packing box 2, the plate member P2-A faces the electronic equipment 100. The plate member P2-A has an opening K2-A. The plate member P2-B is a flat-plate-like member located at the +Xs-side end of the plate portion P2, and a line normal to this member goes in a direction along the +Xs direction. When the cushioning material S and the electronic equipment 100 are encased in the packing box 2, the plate member P2-B faces the packing box 2. The plate member P2-B has an opening K2-B. The plate member P2-C is a flat-plate-like portion located at the +Zs-side end of the plate portion P2, and a line normal to this portion goes in a direction along the +Zs direction. The plate member P2-C links the plate member P2-A and the plate member P2-B to each other.

In the present embodiment, the plate portion P2 has substantially the same shape as that of the plate portion P1. That is, the plate member P2-A has substantially the same shape as that of the plate member P1-A, the plate member P2-B has substantially the same shape as that of the plate member P1-B, and the plate member P2-C has substantially the same shape as that of the plate member P1-C.

As illustrated in FIG. 3, the cushioning block R2 is held by the plate portion P2 between the plate member P2-A and the plate member P2-B.

In the present embodiment, the cushioning block R2 is made of the same material as that of the cushioning block R1 or a material similar thereto and has substantially the same shape as that of the cushioning block R1. Specifically, the cushioning block R2 has a cushioning portion Q-A, which protrudes in the −Xs direction through the opening K2-A formed in the plate member P2-A, a cushioning portion Q-B, which protrudes in the +Xs direction through the opening K2-B formed in the plate member P2-B, and a link portion Q-C, which is provided between the plate member P2-A and the plate member P2-B and links the cushioning portion Q-A and the cushioning portion Q-B to each other.

That is, in the present embodiment, the link portion Q-C of the cushioning block R2 is longer than the opening K2-A in the +Zs direction, and the link portion Q-C of the cushioning block R2 is longer than the opening K2-B in the +Zs direction. Because of this structure, in the present embodiment, it is possible to prevent the cushioning block R2 from coming off through the opening K2-A in the −Xs direction, and to prevent the cushioning block R2 from coming off through the opening K2-B in the +Xs direction.

As illustrated in FIG. 3, the plate portion Ph, which is the −Zs-side end portion of the cushioning material S, includes a plate member Ph-A and a plate member Ph-B.

The plate member Ph-A, one of the two plate members of the plate portion Ph, is a flat-plate-like member located at the +Zs-side end thereof, and a line normal to this member goes in a direction along the +Zs direction. When the cushioning material S and the electronic equipment 100 are encased in the packing box 2, the plate member Ph-A faces the electronic equipment 100. The plate member Ph-A has an opening Kh1-A. The plate member Ph-A further has an opening Kh2-A, which is formed on the +Xs side with respect to the opening Kh1-A. In the present embodiment, the plate member Ph-A is an example of "third plate", and the opening Kh1-A is an example of "third opening".

The plate member Ph-B, the other of the two plate members of the plate portion Ph, is a flat-plate-like member located at the −Zs-side end thereof, and a line normal to this member goes in a direction along the +Zs direction. When the cushioning material S and the electronic equipment 100 are encased in the packing box 2, the plate member Ph-B faces the packing box 2. The plate member Ph-B has an opening Kh1-B. The plate member Ph-B further has an opening Kh2-B, which is formed on the +Xs side with respect to the opening Kh1-B. In the present embodiment, the plate member Ph-B is an example of "fourth plate", and the opening Kh1-B is an example of "fourth opening".

As illustrated in FIG. 3, the cushioning block Rh1 is held by the plate portion Ph between the plate member Ph-A and the plate member Ph-B. Specifically, the cushioning block Rh1 has a cushioning portion Qh-A, which protrudes in the +Zs direction through the opening Kh1-A formed in the plate member Ph-A, a cushioning portion Qh-B, which protrudes in the −Zs direction through the opening Kh1-B formed in the plate member Ph-B, and a link portion Qh-C, which is provided between the plate member Ph-A and the plate member Ph-B and links the cushioning portion Qh-A and the cushioning portion Qh-B to each other. In the present embodiment, the cushioning block Rh1 is an example of "second cushioning block", the cushioning portion Qh-A is an example of "third cushioning portion", the cushioning portion Qh-B is an example of "fourth cushioning portion", and the link portion Qh-C is an example of "second link portion". In the present embodiment, the +Zs direction is an example of "third direction", the −Zs direction is an example of "fourth direction", and the +Xs direction is an example of "second holding direction".

In the description below, the length of the cushioning portion Qh-A in the +Xs direction will be denoted as HQ-A, the length of the cushioning portion Qh-B in the +Xs direction will be denoted as HQ-B, and the length of the link portion Qh-C in the +Xs direction will be denoted as HQ-C. In addition, in the description below, the length of the opening Kh1-A in the +Xs direction will be denoted as HK-A, and the length of the opening Kh1-B in the +Xs direction will be denoted as HK-B. In addition, in the description below, the length from the −Xs-side end of the link portion Qh-C to the cushioning portion Qh-A in the +Xs direction will be denoted as HQ-At1, and the length from the +Xs-side end of the link portion Qh-C to the cushioning portion Qh-A in the +Xs direction will be denoted as HQ-At2. In addition, in the description below, the length from the −Xs-side end of the link portion Qh-C to the cushioning portion Qh-B in the +Xs direction will be denoted as HQ-Bt1, and the length from the +Xs-side end of the link portion Qh-C to the cushioning portion Qh-B in the +Xs direction will be denoted as HQ-Bt2.

In the present embodiment, the length HQ-A is assumed to be substantially the same as the length HK-A. In addition, in the present embodiment, the length HQ-B is assumed to be substantially the same as the length KK-B.

In the present embodiment, the length HQ-C is greater than the length HK-A, and the length HQ-C is greater than the length HK-B. That is, in the present embodiment, the link portion Qh-C is longer than the opening Kh1-A in the +Xs direction, and the link portion Qh-C is longer than the opening Kh1-B in the +Xs direction. Because of this structure, in the present embodiment, it is possible to prevent the cushioning block Rh1 from coming off through the opening Kh1-A in the +Zs direction, and to prevent the cushioning block Rh1 from coming off through the opening Kh1-B in the −Zs direction. In the present embodiment, it is assumed that the cushioning block Rh1 is held by the plate portion Ph without using any adhesive. However, the scope of the present disclosure is not limited to such an exemplary structure. The cushioning block Rh1 may be fixed to the plate portion Ph by means of an adhesive.

In the present embodiment, either one of the length HQ-At1 and the length HQ-Bt1 is, or both are, greater than the length LQ-At and greater than the length LQ-Bt. In other words, in the present embodiment, either one of the length from the −Xs-side end of the link portion Qh-C to the opening Kh1-A in the +Xs direction and the length from the −Xs-side end of the link portion Qh-C to the opening Kh1-B in the +Xs direction is, or both are, greater than the length from the plate member P1-C to the opening K1-A in the +Zs direction and greater than the length from the plate member P1-C to the opening K1-B in the +Zs direction.

In the present embodiment, either one of the length HQ-At2 and the length HQ-Bt2 is, or both are, greater than the length LQ-At and greater than the length LQ-Bt. In other words, in the present embodiment, either one of the length from the +Xs-side end of the link portion Qh-C to the opening Kh1-A in the +Xs direction and the length from the +Xs-side end of the link portion Qh-C to the opening Kh1-B in the +Xs direction is, or both are, greater than the length from the plate member P1-C to the opening K1-A in the +Zs direction and greater than the length from the plate member P1-C to the opening K1-B in the +Zs direction. Therefore, in the present embodiment, it is possible to prevent the cushioning block Rh1 from being mistakenly provided between the plate member P1-A and the plate member P1-B where the cushioning block R1 is supposed to be provided, and to prevent the cushioning block Rh1 from being mistakenly provided between the plate member P2-A and the plate member P2-B where the cushioning block R2 is supposed to be provided. That is, in the present embodiment, it is possible to prevent the occurrence of a mix-up of the cushioning block Rh1 with the cushioning block R1 or the cushioning block R2 when the cushioning material S is manufactured.

In addition, in the present embodiment, either one of the length LQ-A and the length LQ-B is, or both are, greater than the length HK-A and greater than the length HK-B. Therefore, in the present embodiment, it is possible to prevent the cushioning block R1 from being mistakenly provided between the plate member Ph-A and the plate member Ph-B where the cushioning block Rh1 is supposed to be provided, and to prevent the cushioning block R2 from being mistakenly provided between the plate member Ph-A and the plate member Ph-B where the cushioning block Rh1 is supposed to be provided. That is, in the present embodiment, it is possible to prevent the occurrence of a mix-up of the cushioning block R1 or the cushioning block R2 with the cushioning block Rh1 when the cushioning material S is manufactured.

As illustrated in FIG. 3, the cushioning block Rh2 is held by the plate portion Ph between the plate member Ph-A and the plate member Ph-B.

In the present embodiment, the cushioning block Rh2 is made of the same material as that of the cushioning block Rh1 or a material similar thereto and has substantially the same shape as that of the cushioning block Rh1. In the present embodiment, the opening Kh2-A is assumed to have substantially the same shape as that of the opening Kh1-A, and the opening Kh2-B is assumed to have substantially the same shape as that of the opening Kh1-B. The cushioning block Rh2 has a cushioning portion Qh-A, which protrudes in the +Zs direction through the opening Kh2-A formed in the plate member Ph-A, a cushioning portion Qh-B, which protrudes in the −Zs direction through the opening Kh2-B formed in the plate member Ph-B, and the link portion Qh-C, which is provided between the plate member Ph-A and the plate member Ph-B and links the cushioning portion Qh-A and the cushioning portion Qh-B to each other.

Because of this structure, in the present embodiment, it is possible to prevent the cushioning block Rh2 from coming off through the opening Kh2-A in the +Zs direction, and to prevent the cushioning block Rh2 from coming off through the opening Kh2-B in the −Zs direction. In the present embodiment, it is assumed that the cushioning block Rh2 is held by the plate portion Ph without using any adhesive. However, the scope of the present disclosure is not limited to such an exemplary structure. The cushioning block Rh2 may be fixed to the plate portion Ph by means of an adhesive.

Moreover, in the present embodiment, either one of the length from the +Xs-side end of the link portion Qh-C to the opening Kh2-A in the +Xs direction and the length from the +Xs-side end of the link portion Qh-C to the opening Kh2-B in the +Xs direction is, or both are, greater than the length from the plate member P1-C to the opening K1-A in the +Zs direction and greater than the length from the plate member P1-C to the opening K1-B in the +Zs direction. Furthermore, in the present embodiment, either one of the length from the −Xs-side end of the link portion Qh-C to the opening Kh2-A in the +Xs direction and the length from the −Xs-side end of the link portion Qh-C to the opening Kh2-B in the +Xs direction is, or both are, greater than the length from the plate member P1-C to the opening K1-A in the +Zs direction and greater than the length from the plate member P1-C to the opening K1-B in the +Zs direction.

Therefore, in the present embodiment, it is possible to prevent the cushioning block Rh2 from being mistakenly provided between the plate member P1-A and the plate member P1-B where the cushioning block R1 is supposed to be provided, and to prevent the cushioning block Rh2 from being mistakenly provided between the plate member P2-A and the plate member P2-B where the cushioning block R2 is supposed to be provided. That is, in the present embodiment, it is possible to prevent the occurrence of a mix-up of the cushioning block Rh2 with the cushioning block R1 or the cushioning block R2 when the cushioning material S is manufactured.

In addition, in the present embodiment, either one of the length LQ-A and the length LQ-B is, or both are, greater than the length HK-A and greater than the length HK-B as described above. Therefore, in the present embodiment, it is possible to prevent the cushioning block R1 from being mistakenly provided between the plate member Ph-A and the plate member Ph-B where the cushioning block Rh2 is supposed to be provided, and to prevent the cushioning block R2 from being mistakenly provided between the plate member Ph-A and the plate member Ph-B where the cushioning block Rh2 is supposed to be provided. That is, in the present embodiment, it is possible to prevent the occurrence of a mix-up of the cushioning block R1 or the cushioning block R2 with the cushioning block Rh2 when the cushioning material S is manufactured.

1.3. Overview of Holder

Figure 4:
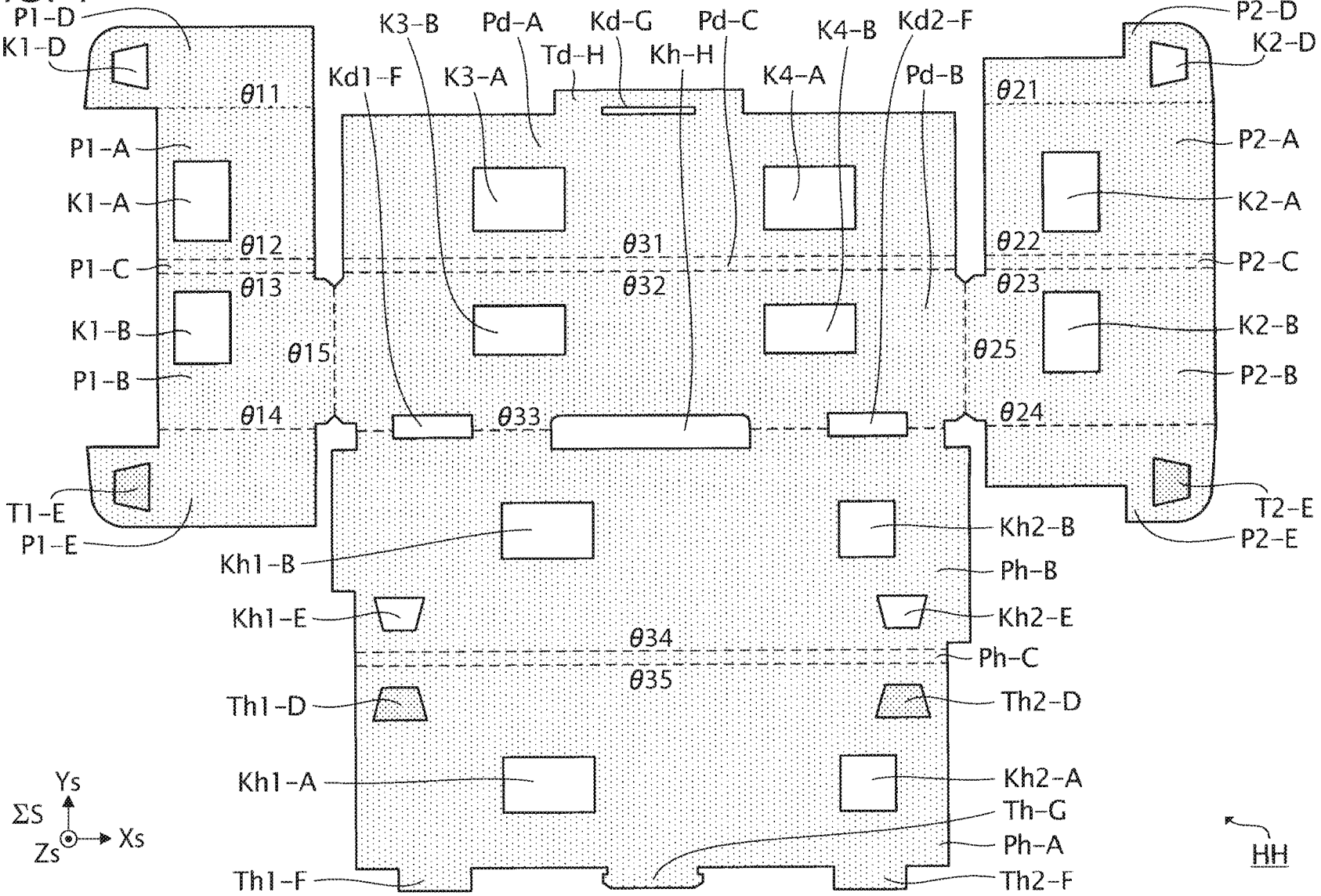
FIG. 4 is a plan view illustrating an example of a shape of a flat plate-like member HH.

FIG. 4 is a plan view illustrating an example of a shape of a flat plate-like member HH obtained by developing (flattening) the holder H.

In the present embodiment, for example, it is assumed that the holder H is formed by folding the flat plate-like member HH illustrated as an example in FIG. 4 along fold lines θ11 to θ35 illustrated as an example in FIG. 4. As described earlier, in the present embodiment, a case where the flat plate-like member HH is made of corrugated cardboard is assumed as an example.

As illustrated in FIG. 4, besides the plate member P1-A, the plate member P1-B, the plate member P1-C, the plate member P2-A, the plate member P2-B, the plate member P2-C, the plate member Ph-A, and the plate member Ph-B, which have been described with reference to FIG. 3, the flat plate-like member HH includes a plate member P1-D, a plate member P1-E, a plate member P2-D, a plate member P2-E, a plate member Ph-C, a plate member Pd-A, a plate member Pd-B, and a plate member Pd-C. In FIG. 4, the following case is assumed as an example: a case where the cushioning material coordinate system ΣS is a coordinate system fixed to the plate member Ph-B and where the flat plate-like member HH is obtained by developing the holder H in a state in which the cushioning material coordinate system ΣS is fixed to the plate member Ph-B.

As illustrated in FIG. 4, the plate member P1-D is continuous to the plate member P1-A across the fold line θ11, the plate member P1-A is continuous to the plate member P1-C across the fold line θ12, the plate member P1-C is continuous to the plate member P1-B across the fold line θ13, and the plate member P1-B is continuous to the plate member P1-E across the fold line θ14. In addition, the plate member P2-D is continuous to the plate member P2-A across the fold line θ21, the plate member P2-A is continuous to the plate member P2-C across the fold line θ22, the plate member P2-C is continuous to the plate member P2-B across the fold line θ23, and the plate member P2-B is continuous to the plate member P2-E across the fold line θ24. Moreover, the plate member P1-B is continuous to the plate member Pd-B across the fold line θ15, and the plate member P2-B is continuous to the plate member Pd-B across the fold line θ25. Furthermore, the plate member Pd-A is continuous to the plate member Pd-C across the fold line θ31, the plate member Pd-C is continuous to the plate member Pd-B across the fold line θ32, the plate member Pd-B is continuous to the plate member Ph-B across the fold line θ33, the plate member Ph-B is continuous to the plate member Ph-C across the fold line θ34, and the plate member Ph-C is continuous to the plate member Ph-A across the fold line θ35.

In the present embodiment, the fold lines θ11 and θ21 are mountain fold lines, and those other than the fold lines θ11 and θ21 are valley fold lines. The term "valley fold line" as used herein means a fold line at which the flat plate-like member HH is folded along this fold line toward the near side in the figure, that is, toward the +Zs direction, for the two plate members adjoining each other across this fold line in a process of forming the holder H from the flat plate-like member HH. The term "mountain fold line" as used herein means a fold line at which the flat plate-like member HH is folded along this fold line toward the opposite side in the figure, that is, toward the −Zs direction, for the two plate members adjoining each other across this fold line in a process of forming the holder H from the flat plate-like member HH.

As illustrated in FIG. 4, the plate member P1-D has an opening K1-D formed therein, the plate member P1-A has the opening K1-A formed therein, the plate member P1-B has the opening K1-B formed therein, and the plate member P1-E has a protrusion T1-E formed thereon. The plate member P2-D has an opening K2-D formed therein, the plate member P2-A has the opening K2-A formed therein, the plate member P2-B has the opening K2-B formed therein, and the plate member P2-E has a protrusion T2-E formed thereon. The plate member Pd-A has an opening K3-A, an opening K4-A, and an opening Kd-G formed therein, and the plate member Pd-B has an opening K3-B and an opening K4-B formed therein. There are an opening Kd1-F, an opening Kd2-F, and an opening Kh-H on the fold line θ33, which is the border between the plate member Pd-B and the plate member Ph-B. The plate member Ph-B has the opening Kh1-B, the opening Kh2-B, an opening Kh1-E, and an opening Kh2-E formed therein. The plate member Ph-A has the opening Kh1-A and the opening Kh1-B formed therein and has a protrusion Th1-D and a protrusion Th2-D formed thereon. The plate member Pd-A further has a protruding portion Td-H jutting out in the +Ys direction as illustrated in FIG. 4. The plate member Ph-A further has a protruding portion Th-G, a protruding portion Th1-F, and a protruding portion Th2-F jutting out in the −Ys direction as illustrated in FIG. 4.

The flat plate-like member HH is folded along the fold lines θ11 and θ21 in a mountain-folding manner and along the fold lines θ12 to θ15, θ22 to θ25, and θ31 to θ35 in a valley-folding manner, thereby fitting the protrusion T1-E into the opening K1-D, fitting the protrusion T2-E into the opening K2-D, fitting the protrusion Th1-D into the opening Kh1-E, fitting the protrusion Th2-D into the opening Kh2-E, fitting the protruding portion Th1-F into the opening Kd1-F, fitting the protruding portion Th2-F into the opening Kd2-F, fitting the protruding portion Td-H into the opening Kh-H, and fitting the protruding portion Th-G into the opening Kd-G. When the flat plate-like member HH is folded along the fold lines θ11 to θ35, the cushioning block R1 is fitted into the opening K1-A and the opening K1-B such that the cushioning block R1 is held between the plate member P1-A and the plate member P1-B, the cushioning block R2 is fitted into the opening K2-A and the opening K2-B such that the cushioning block R2 is held between the plate member P2-A and the plate member P2-B, the cushioning block R3 is fitted into the opening K3-A and the opening K3-B such that the cushioning block R3 is held between the plate member Pd-A and the plate member Pd-B, the cushioning block R4 is fitted into the opening K4-A and the opening K4-B such that the cushioning block R4 is held between the plate member Pd-A and the plate member Pd-B, the cushioning block Rh1 is fitted into the opening Kh1-A and the opening Kh1-B such that the cushioning block Rh1 is held between the plate member Ph-A and the plate member Ph-B, and the cushioning block Rh2 is fitted into the opening Kh2-A and the opening Kh2-B such that the cushioning block Rh2 is held between the plate member Ph-A and the plate member Ph-B.

In the present embodiment, each of the cushioning block R3 and the cushioning block R4 is made of the same material as that of the cushioning block R1 or a material similar thereto. In addition, similarly to the cushioning block R1 and the cushioning block R2, each of the cushioning block R3 and the cushioning block R4 is formed to have a shape that makes it possible to prevent the occurrence of a mix-up of the cushioning block R3, R4 with the cushioning block Rh1, Rh2 when the cushioning material S is manufactured. In the present embodiment, the cushioning block R3, R4 has a shape different from that of the cushioning block R1, R2. However, the cushioning block R3, R4 may have the same shape as that of the cushioning block R1, R2.

1.4. Referential Example 1

Figure 5:
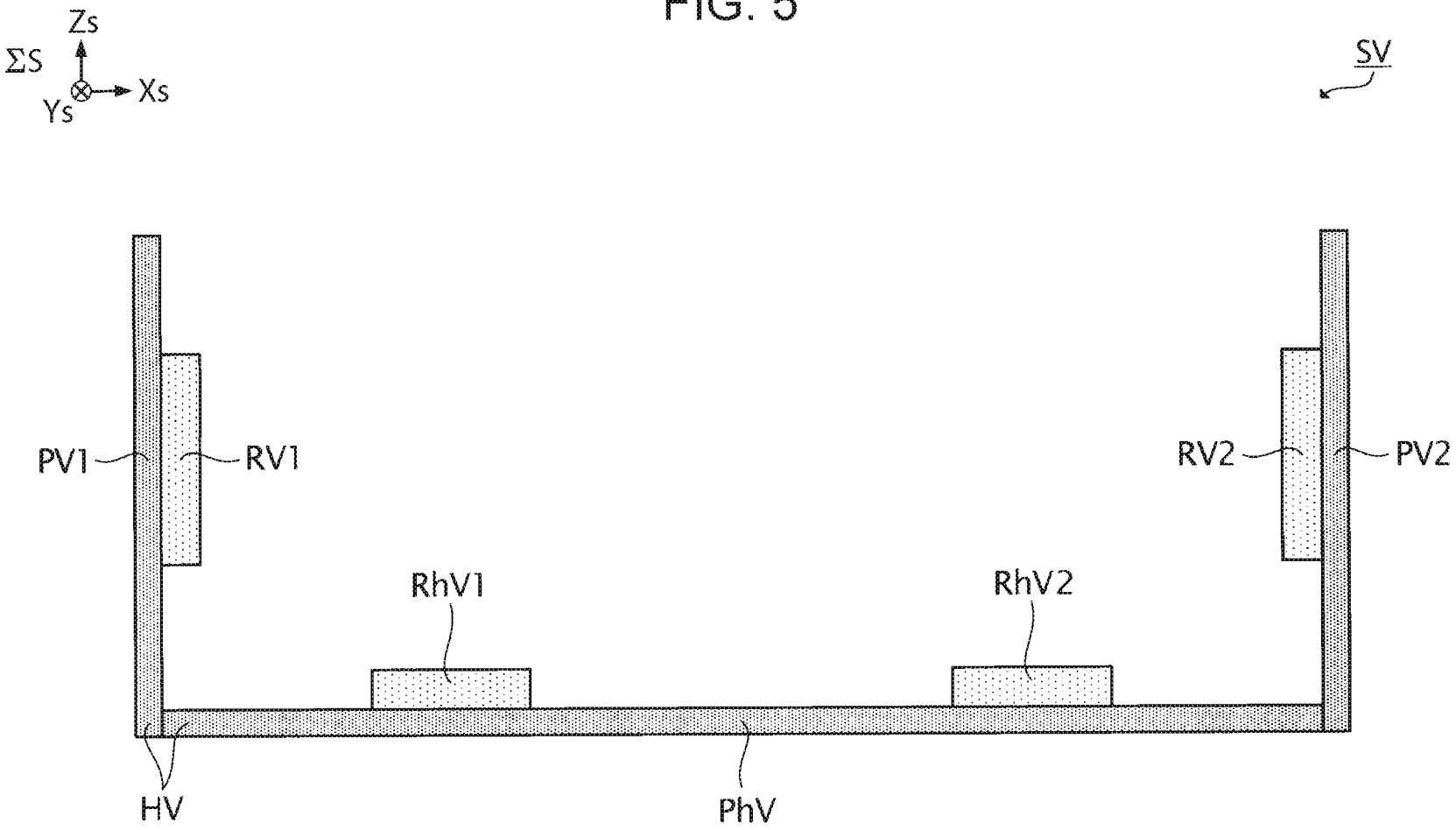
FIG. 5 is a cross-sectional view illustrating an example of a structure of a cushioning material SV according to a referential example 1.

FIG. 5 is a cross-sectional view illustrating an example of a cross section of a cushioning material SV according to a referential example 1.

As illustrated in FIG. 5, the cushioning material SV according to the referential example 1 is different from the cushioning material S according to the first embodiment in that, firstly, it includes a holder HV in place of the holder H, and, secondly, it includes a plurality of cushioning blocks RV in place of the plurality of cushioning blocks R.

The holder HV according to the referential example 1 is different from the holder H according to the first embodiment in that it includes a plate portion PV1, a plate portion PV2, and a plate portion PhV in place of the plate portion P1, the plate portion P2, and the plate portion Ph. The plurality of cushioning blocks RV of the cushioning material SV includes a cushioning block RV1, a cushioning block RV2, a cushioning block RhV1, and a cushioning block RhV2.

The cushioning block RV according to the referential example 1 is made of the same material as that of the cushioning block R according to the first embodiment. In addition, the cushioning blocks RV according to the referential example 1 are attached to the holder HV by means of adhesive.

As described here, in the referential example 1, the cushioning blocks RV are attached to the holder HV by means of adhesive. Therefore, in the referential example 1, the burden of detaching the cushioning blocks RV from the holder HV is heavier when the cushioning material SV is taken apart. Moreover, in the referential example 1, it is difficult to perfectly remove the cushioning blocks RV from the holder HV when the cushioning material SV is taken apart, and, therefore, a part of the cushioning blocks RV could in some instances remain bonded to the plate portion PV1, PV2, and/or PhV even after the cushioning material SV is taken apart. For this reason, in the referential example 1, the recyclability of the cushioning material SV is low when the cushioning blocks RV are made of a material different from that of the holder HV.

By contrast, in the present embodiment, the cushioning blocks R are attached to the holder H without using any adhesive. Therefore, in the present embodiment, in comparison with the referential example 1, it is possible to make the burden of detaching the cushioning blocks R from the holder H lighter when the cushioning material S is taken apart. Moreover, unlike the referential example 1, the present embodiment realizes easy perfect removal of the cushioning blocks R from the holder H when the cushioning material S is taken apart. Therefore, the present embodiment makes it possible to make the recyclability of the cushioning material S higher than that of the referential example 1.

Furthermore, when external stress is absorbed by the cushioning material SV as done in the referential example 1, the external stress applied to the electronic equipment 100 is absorbed not only by the cushioning block RV but also by the holder HV. Therefore, in the referential example 1, in order to achieve efficient absorption of the external stress by the cushioning material SV, it is necessary to take into consideration not only the absorption of the external stress applied to the electronic equipment 100 by the cushioning block RV but also the absorption of the external stress applied to the electronic equipment 100 by the holder HV. That is, in the referential example 1, it is difficult to accurately suppress the external stress applied to the electronic equipment 100 by the cushioning material SV.

By contrast, in the present embodiment, when external stress is absorbed by the cushioning material S, the external stress applied to the electronic equipment 100 is absorbed by the cushioning block R only. Therefore, in the present embodiment, in order to achieve efficient absorption of the external stress by the cushioning material S, just taking the absorption of the external stress applied to the electronic equipment 100 by the cushioning block R into consideration suffices. This makes the design of the cushioning material S easier than that of the referential example 1.

1.5. Conclusion of First Embodiment

As described above, the cushioning material S according to the present embodiment is a cushioning material for being put into the packing box 2 configured for encasement of the electronic equipment 100. The cushioning material is configured to absorb external stress applied to the electronic equipment 100 encased in the packing box 2. The cushioning material comprises the holder H and the cushioning block R1. The holder H includes the plate member P1-A having the opening K1-A and configured to face the electronic equipment 100 when the cushioning material S and the electronic equipment 100 are encased in the packing box 2, and the plate member P1-B having the opening K1-B and configured to face an inner wall surface of the packing box 2 when the cushioning material S and the electronic equipment 100 are encased in the packing box 2. The cushioning block R1 is held by the holder H between the plate member P1-A and the plate member P1-B. The cushioning block R1 includes the cushioning portion Q-A protruding through the opening K1-A in the +Xs direction going from the plate member P1-A toward the electronic equipment 100 and configured to be in contact with the electronic equipment 100, the cushioning portion Q-B protruding through the opening K1-B in the −Xs direction going from the plate member P1-B toward the inner wall surface of the packing box 2 and configured to be in contact with the inner wall surface of the packing box 2, and the link portion Q-C provided between the plate member P1-A and the plate member P1-B and linking the cushioning portion Q-A and the cushioning portion Q-B to each other. The link portion Q-C is longer than the opening K1-A and the opening K1-B in the +Zs direction intersecting with the +Xs direction and the −Xs direction.

Because of this structure, in the present embodiment, it is possible to prevent the cushioning block R1 from coming off through the opening K1-A in the +Xs direction, and to prevent the cushioning block R1 from coming off through the opening K1-B in the −Xs direction. Therefore, in the present embodiment, it is possible to keep a state of being able to absorb external stress applied to the electronic equipment 100 by means of the cushioning block R1 and to avoid a possibility that the cushioning block R1 might become unable to protect the electronic equipment 100. Moreover, in the present embodiment, it is possible to hold the cushioning block R1 by the holder H between the plate member P1-A and the plate member P1-B.

In the present embodiment, the holder H includes the plate member P1-C linking the plate member P1-A and the plate member P1-B to each other, and a width of the cushioning block R1 is greater than a width of the plate member P1-C in the +Xs direction.

Therefore, in the present embodiment, even if external stress is applied to the packing box 2, it is possible to absorb the external stress by the cushioning block R1, thereby softening the external force transmitted to the electronic equipment 100.

The cushioning material S according to the present embodiment further comprises the cushioning block Rh1. The holder H further includes the plate member Ph-A having the opening Kh1-A and configured to face the electronic equipment 100 when the cushioning material S and the electronic equipment 100 are encased in the packing box 2, and the plate member Ph-B having the opening Kh1-B and configured to face an inner wall surface of the packing box 2 when the cushioning material S and the electronic equipment 100 are encased in the packing box 2. The cushioning block Rh1 includes the cushioning portion Qh-A protruding through the opening Kh1-A in the +Zs direction going from the plate member Ph-A toward the electronic equipment 100 and configured to be in contact with the electronic equipment 100, the cushioning portion Qh-B protruding through the opening Kh1-B in the −Zs direction going from the plate member Ph-B toward the inner wall surface of the packing box 2 and configured to be in contact with the inner wall surface of the packing box 2, and the link portion Qh-C provided between the plate member Ph-A and the plate member Ph-B and linking the cushioning portion Qh-A and the cushioning portion Qh-B to each other. The link portion Qh-C is longer than the opening Kh1-A and the opening Kh1-B in the +Xs direction intersecting with the +Zs direction and the −Zs direction. Either one of the length LQ-A of the cushioning portion Q-A in the +Zs direction and the length LQ-B of the cushioning portion Q-B in the +Zs direction is, or both are, greater than the length HK-A of the opening Kh1-A in the +Xs direction and greater than the length HK-B of the opening Kh1-B in the +Xs direction.

Therefore, in the present embodiment, it is possible to prevent the cushioning block R1 from being mistakenly provided between the plate member Ph-A and the plate member Ph-B where the cushioning block Rh1 is supposed to be provided. That is, in the present embodiment, it is possible to prevent the occurrence of a mix-up of the cushioning block R1 with the cushioning block Rh1 when the cushioning material S is manufactured.

The cushioning material S according to the present embodiment further comprises the cushioning block Rh1. The holder H further includes the plate member P1-C linking the plate member P1-A and the plate member P1-B to each other, the plate member Ph-A having the opening Kh1-A and configured to face the electronic equipment 100 when the cushioning material S and the electronic equipment 100 are encased in the packing box 2, and the plate member Ph-B having the opening Kh1-B and configured to face an inner wall surface of the packing box 2 when the cushioning material S and the electronic equipment 100 are encased in the packing box 2. The cushioning block Rh1 includes the cushioning portion Qh-A protruding through the opening Kh1-A in the +Zs direction going from the plate member Ph-A toward the electronic equipment 100 and configured to be in contact with the electronic equipment 100, the cushioning portion Qh-B protruding through the opening Kh1-B in the −Zs direction going from the plate member Ph-B toward the inner wall surface of the packing box 2 and configured to be in contact with the inner wall surface of the packing box 2, and the link portion Qh-C provided between the plate member Ph-A and the plate member Ph-B and linking the cushioning portion Qh-A and the cushioning portion Qh-B to each other. The link portion Qh-C is longer than the opening Kh1-A and the opening Kh1-B in the +Xs direction intersecting with the +Zs direction and the −Zs direction. Either one of the length HQ-At2 from the +Xs-side end of the link portion Qh-C to the opening Kh1-A in the +Xs direction and the length HQ-Bt2 from the +Xs-side end of the link portion Qh-C to the opening Kh1-B in the +Xs direction is, or both are, greater than the length LQ-At from the plate member P1-C to the opening K1-A in the +Zs direction and greater than the length LQ-Bt from the plate member P1-C to the opening K1-B in the +Zs direction.

Therefore, in the present embodiment, it is possible to prevent the cushioning block Rh1 from being mistakenly provided between the plate member P1-A and the plate member P1-B where the cushioning block R1 is supposed to be provided. That is, in the present embodiment, it is possible to prevent the occurrence of a mix-up of the cushioning block Rh1 with the cushioning block R1 when the cushioning material S is manufactured.

2. Second Embodiment

A second embodiment of the present disclosure will now be explained. In each exemplary structure of the embodiment described below, the same reference numerals as those used in the description of the first embodiment are assigned to elements that are the same in operation and/or function as those in the first embodiment, and a detailed explanation of them is omitted.

2.1. Overview of Cushioning Material

Figure 6:
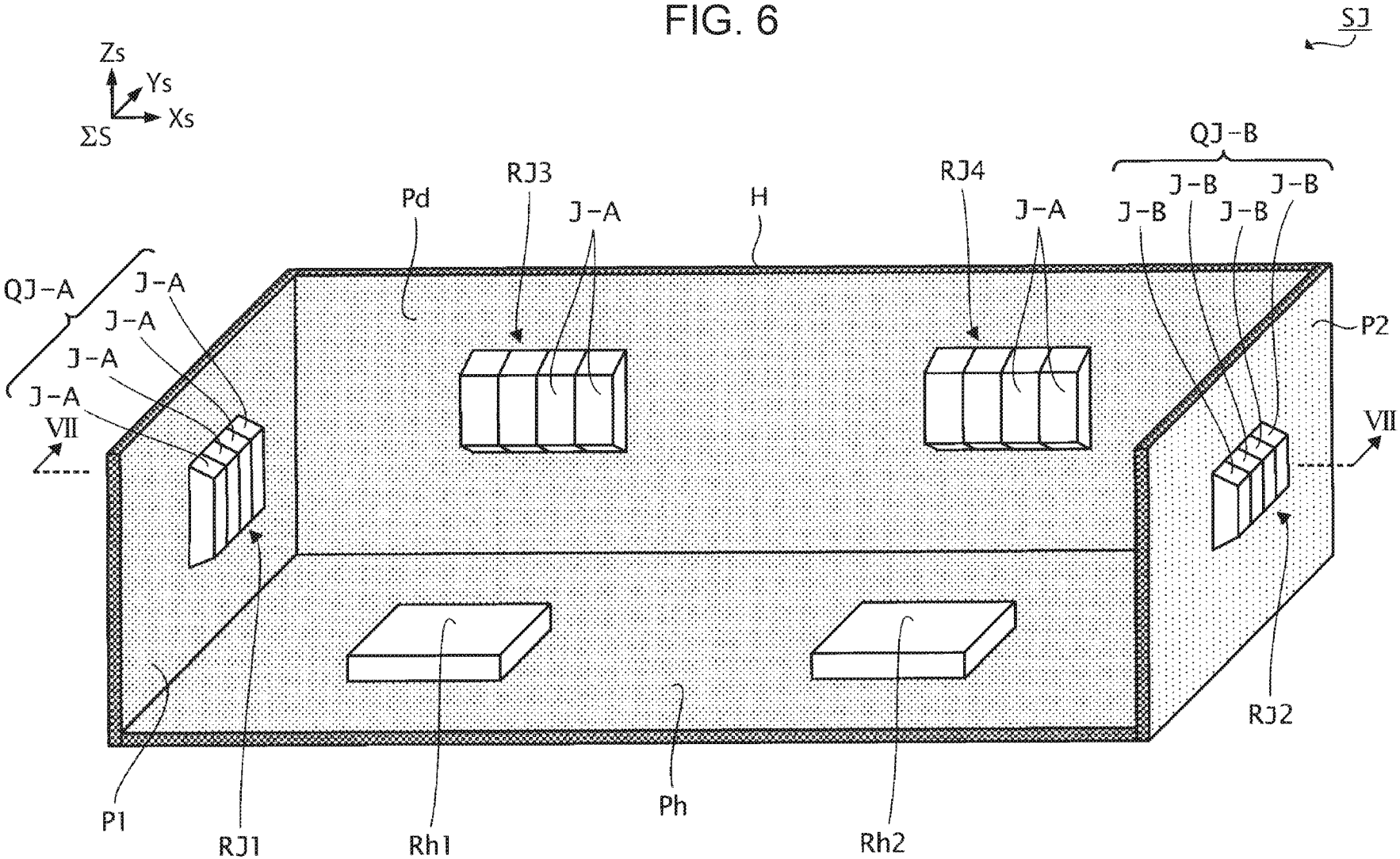
FIG. 6 is a perspective view illustrating an example of a structure of a packing material SJ according to a second embodiment of the present disclosure.
Figure 7:
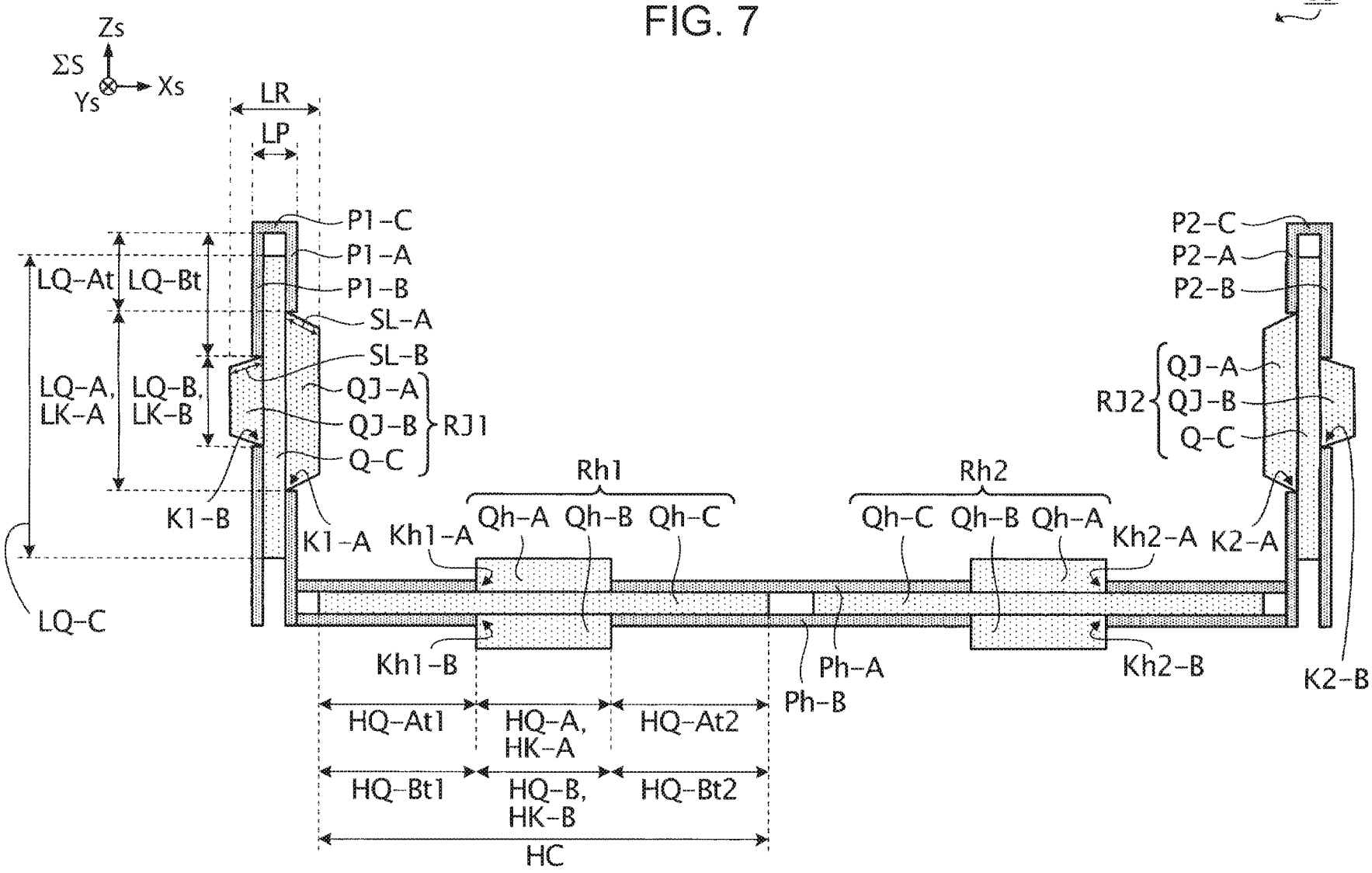
FIG. 7 is a cross-sectional view illustrating an example of a structure of the cushioning material SJ.

With reference to FIGS. 6 and 7, a cushioning material SJ according to the present embodiment will now be explained.

FIG. 6 is a perspective view illustrating an example of a structure of a cushioning material SJ used as a component of a packing material according to a second embodiment. FIG. 7 is a cross-sectional view illustrating an example of a cross section of the cushioning material SJ taken along the line VII-VII of FIG. 6. The packing material according to the second embodiment is the same as the packing material 1 according to the first embodiment except that it includes the cushioning material SJ in place of the cushioning material S.

As illustrated in FIG. 6, the cushioning material SJ is different from the cushioning material S according to the first embodiment in that it includes a cushioning block RJ1, a cushioning block RJ2, a cushioning block RJ3, and a cushioning block RJ4 in place of the cushioning block R1, the cushioning block R2, the cushioning block R3, and the cushioning block R4. The cushioning block RJ1, the cushioning block RJ2, the cushioning block RJ3, and the cushioning block RJ4 may be hereinafter collectively referred to as "cushioning block RJ".

In the present embodiment, a case where the cushioning block RJ1, the cushioning block RJ2, the cushioning block RJ3, and the cushioning block RJ4 are identical in shape is assumed as an example. However, the scope of the present disclosure is not limited to such an exemplary structure. Any one or more of the plurality of the cushioning blocks RJ may have a shape different from that of the others. Moreover, in the present embodiment, a case where the cushioning block RJ is made of the same material as that of the cushioning block R according to the first embodiment described above or a material similar thereto is assumed as an example.

With reference to FIGS. 6 and 7, the cushioning block RJ will be described below, with the cushioning block RJ1 taken as an example.

In the present embodiment, the cushioning block RJ1 is different from the cushioning block R1 in that it includes a cushioning portion QJ-A in place of the cushioning portion Q-A and includes a cushioning portion QJ-B in place of the cushioning portion Q-B. The cushioning block RJ1 is another example of "first cushioning block".

The cushioning portion QJ-A provided as a portion of the cushioning block RJ1 is configured to be in contact with the electronic equipment 100 when the electronic equipment 100 and the cushioning material SJ are encased in the packing box 2. In the present embodiment, the cushioning portion QJ-A provided as a portion of the cushioning block RJ1 includes a plurality of cushioning sheets J-A "stacked" in the +Ys direction. The cushioning portion QJ-A provided as a portion of the cushioning block RJ1 is another example of "first cushioning portion".

As described earlier, the +Zw direction and the −Zw direction are parallel to the +Zs direction and the −Zs direction. The +Ys direction intersects with the +Zs direction. Therefore, the +Ys direction is a direction intersecting with the −Zw direction, in which the electronic equipment 100 and the cushioning material SJ are put into the packing box 2, and intersecting with the +Zw direction, in which the electronic equipment 100 and the cushioning material SJ are taken out of the packing box 2.

In the present embodiment, each cushioning sheet J-A has a so-called "vertically long" shape, meaning that its length in the +Zs direction is greater than its length in the +Xs direction and its length in the +Ys direction. The cushioning sheet J-A has a sloped surface SL-A. In the present embodiment, the sloped surface SL-A of the cushioning sheet J-A of the cushioning block RJ1 is a plane having its normal line going in a direction between the +Xs direction and the +Zs direction.

The cushioning portion QJ-B provided as a portion of the cushioning block RJ1 is configured to be in contact with an inner wall surface of the packing box 2 when the electronic equipment 100 and the cushioning material SJ are encased in the packing box 2. The cushioning portion QJ-B provided as a portion of the cushioning block RJ1 is another example of "second cushioning portion".

In the present embodiment, the cushioning portion QJ-B provided as a portion of the cushioning block RJ1 includes a plurality of cushioning sheets J-B stacked in the +Ys direction.

In the present embodiment, each cushioning sheet J-B has a so-called "vertically long" shape, meaning that its length in the +Zs direction is greater than its length in the +Xs direction and its length in the +Ys direction. The cushioning sheet J-B has a sloped surface SL-B. In the present embodiment, the sloped surface SL-B of the cushioning sheet J-B of the cushioning block RJ1 is a plane having its normal line going in a direction between the −Xs direction and the +Zs direction.

In the present embodiment, each of the cushioning block RJ2, the cushioning block RJ3, and the cushioning block RJ4 has the cushioning portion QJ-A including the plurality of cushioning sheets J-A, the cushioning portion QJ-B including the plurality of cushioning sheets J-B, and the link portion Q-C, similarly to the cushioning block RJ1. Among them, in the cushioning block RJ2, the cushioning portion QJ-A is made up of the plurality of cushioning sheets J-A stacked in the +Ys direction, and the cushioning portion QJ-B is made up of the plurality of cushioning sheets J-B stacked in the +Ys direction. In the cushioning block RJ3 and the cushioning block RJ4, the cushioning portion QJ-A is made up of the plurality of cushioning sheets J-A stacked in the +Xs direction, and the cushioning portion QJ-B is made up of the plurality of cushioning sheets J-B stacked in the +Xs direction. The +Xs direction is a direction intersecting with the −Zw direction, in which the electronic equipment 100 and the cushioning material SJ are put into the packing box 2, and intersecting with the +Zw direction, in which the electronic equipment 100 and the cushioning material SJ are taken out of the packing box 2.

2.2. Referential Example 2

Figure 8:
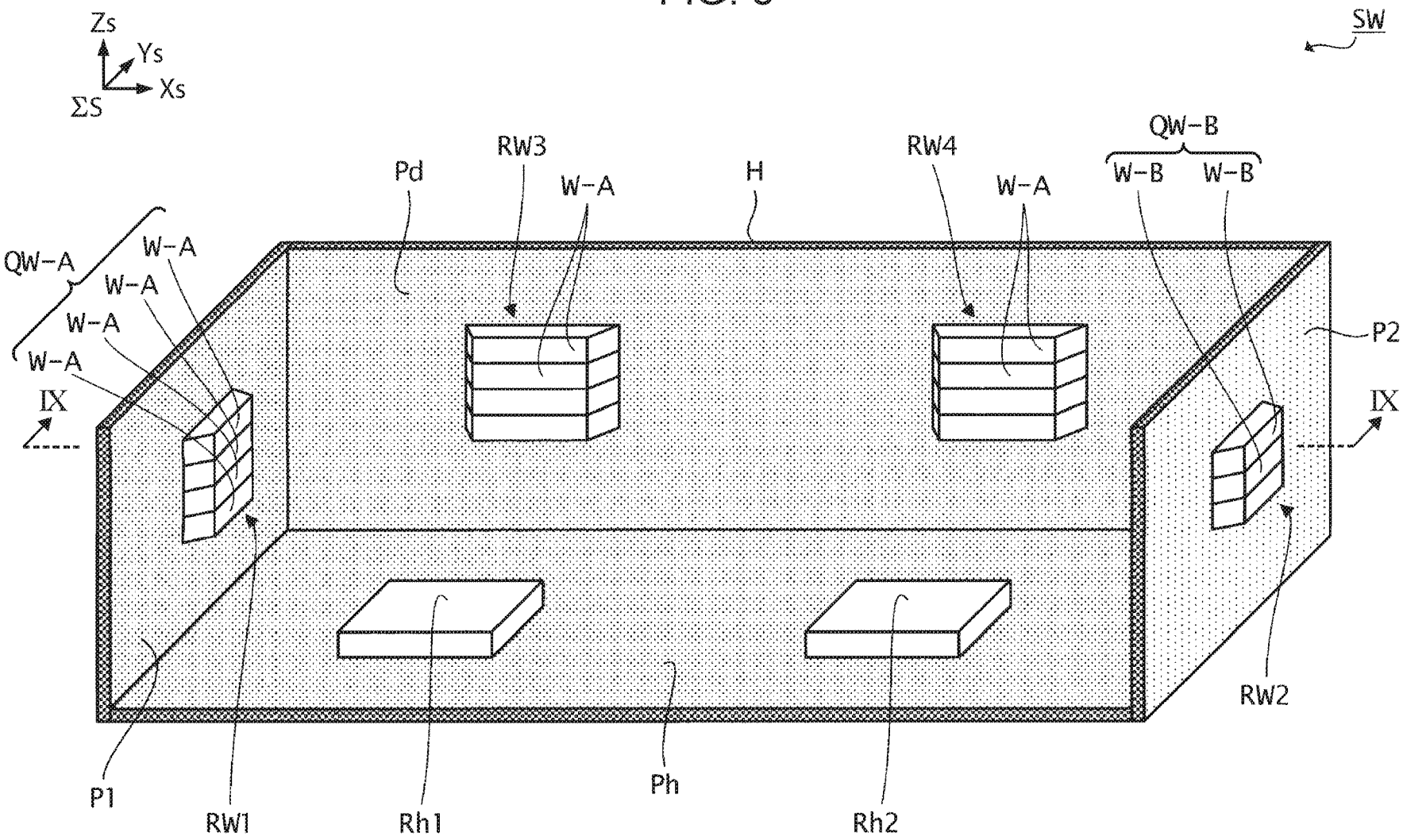
FIG. 8 is a perspective view illustrating an example of a structure of a cushioning material SW according to a referential example 2.
Figure 9:
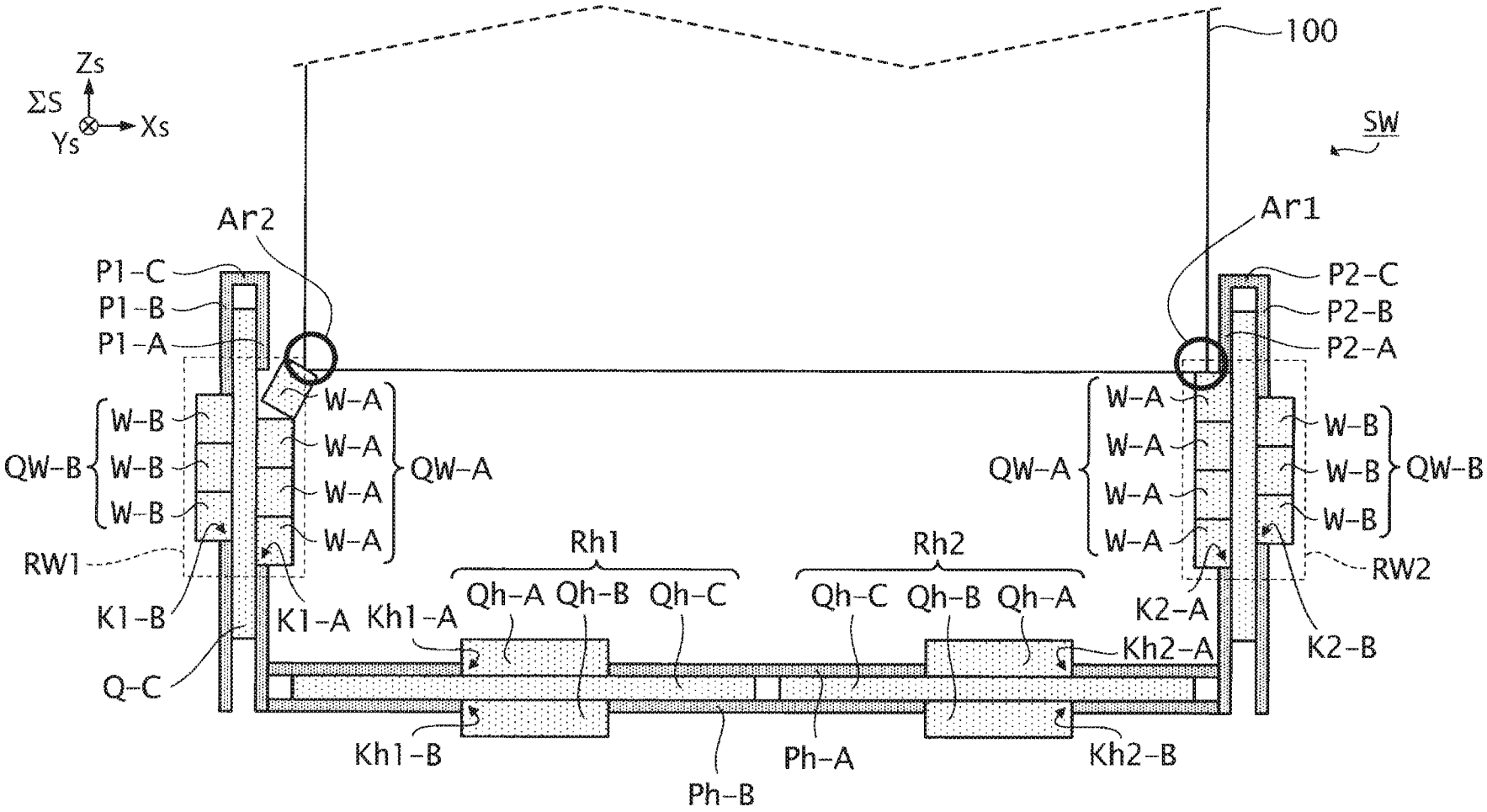
FIG. 9 is a cross-sectional view illustrating an example of a structure of the cushioning material SW.

With reference to FIGS. 8 and 9, a cushioning material SW according to a referential example 2 will now be explained.

FIG. 8 is a perspective view illustrating an example of a structure of a cushioning material SW used as a component of a packing material according to a referential example 2. FIG. 9 is a cross-sectional view illustrating an example of a cross section of the cushioning material SW taken along the line IX-IX of FIG. 8. The packing material according to the referential example 2 is different from the packing material according to the second embodiment in that it includes the cushioning material SW in place of the cushioning material SJ.

As illustrated in FIG. 8, the cushioning material SW is different from the cushioning material SJ according to the second embodiment in that it includes a cushioning block RW1, a cushioning block RW2, a cushioning block RW3, and a cushioning block RW4 in place of the cushioning block RJ1, the cushioning block RJ2, the cushioning block RJ3, and the cushioning block RJ4. The cushioning block RW1, the cushioning block RW2, the cushioning block RW3, and the cushioning block RW4 may be hereinafter collectively referred to as "cushioning block RW". In the referential example 2, a case where the cushioning block RW1, the cushioning block RW2, the cushioning block RW3, and the cushioning block RW4 are identical in shape is assumed as an example.

With reference to FIGS. 8 and 9, the cushioning block RW will be described below, with the cushioning block RW1 taken as an example.

The cushioning block RW1 according to the referential example 2 is different from the cushioning block RJ1 in that it includes a cushioning portion QW-A in place of the cushioning portion QJ-A and includes a cushioning portion QW-B in place of the cushioning portion QJ-B.

The cushioning portion QW-A provided as a portion of the cushioning block RW1 is configured to be in contact with the electronic equipment 100 when the electronic equipment 100 and the cushioning material SW are encased in the packing box 2. In the referential example 2, the cushioning portion QW-A provided as a portion of the cushioning block RW1 includes a plurality of cushioning sheets W-A stacked in the +Zs direction. In the referential example 2, each cushioning sheet W-A of the cushioning block RW1 has a so-called "horizontally long" shape, meaning that its length in the +Ys direction is greater than its length in the +Xs direction and its length in the +Zs direction.

The cushioning portion QW-B provided as a portion of the cushioning block RW1 is configured to be in contact with an inner wall surface of the packing box 2 when the electronic equipment 2 and the cushioning material SW are encased in the packing box 2. In the referential example 2, the cushioning portion QW-B provided as a portion of the cushioning block RW1 includes a plurality of cushioning sheets W-B stacked in the +Zs direction. In the referential example 2, each cushioning sheet W-B of the cushioning block RW1 has a so-called "horizontally long" shape, meaning that its length in the +Ys direction is greater than its length in the +Xs direction and its length in the +Zs direction.

In the referential example 2, each of the cushioning block RW2, the cushioning block RW3, and the cushioning block RW4 has the cushioning portion QW-A including the plurality of cushioning sheets W-A stacked in the +Zs direction, the cushioning portion QW-B including the plurality of cushioning sheets W-B stacked in the +Zs direction, and the link portion Q-C, similarly to the cushioning block RW1.

As illustrated in FIG. 9, when the electronic equipment 100 is being put into the packing material according to the referential example 2, the electronic equipment 100 that is being lowered in the −Zs direction could come into contact with the cushioning portion QW-A of the cushioning block RW provided as a block of the cushioning material SW of the packing material according to the referential example 2. As a result, as illustrated in an area Ar1 of FIG. 9, it could happen that the electronic equipment 100 gets stuck on the +Zs-side end of the cushioning portion QW-A, thereby making it impossible to encase the electronic equipment 100 in the box of the packing material. Moreover, as illustrated in an area Ar2 of FIG. 9, since the electronic equipment 100 that is being lowered in the −Zs direction applies a strong force to the cushioning sheet W-A located at the +Zs-side end among those of the cushioning portion QW-A, it could happen that the cushioning sheet W-A comes off of the cushioning block RW. Furthermore, when the cushioning material SW is being put into the packing box 2, it could happen that a part of the plurality of cushioning sheets W-B constituting the cushioning portion QW-B of the cushioning block RW could come off of the cushioning block RW due to friction generated between the packing box 2 and the cushioning material SW.

By contrast, in the present embodiment, when the electronic equipment 100 is being put into the packing material, the electronic equipment 100 that is being lowered in the −Zs direction comes into contact with the cushioning portion QJ-A of the cushioning block RJ provided as a block of the cushioning material SJ of the packing material according to the second embodiment. Each of the plurality of cushioning sheets J-A constituting the cushioning portion QJ-A has the sloped surface SL-A at its+Zs-side end. Therefore, as compared with the referential example 2, the present embodiment reduces the possibility that the electronic equipment 100 that is being lowered in the −Zs direction might get stuck on the +Zs-side end of the cushioning portion QJ-A. Moreover, in the present embodiment, the cushioning portion QJ-A includes the cushioning sheet J-A that is longer in the +Zs direction, instead of the cushioning sheet W-A that is longer in the +Ys direction. Therefore, as compared with the referential example 2, the present embodiment reduces the possibility that the cushioning sheet J-A might come off of the cushioning block RJ due to the effect of the electronic equipment 100 that is being lowered in the −Zs direction. Furthermore, in the present embodiment, the cushioning portion QJ-B includes the cushioning sheet J-B that is longer in the +Zs direction, instead of the cushioning sheet W-B that is longer in the +Ys direction. Therefore, as compared with the referential example 2, the present embodiment reduces the possibility that the cushioning sheet J-B might come off of the cushioning block RJ due to the effect of friction generated between the packing box 2 and the cushioning material SJ.

2.3. Conclusion of Second Embodiment

As explained above, the packing material according to the present embodiment includes the packing box 2 configured for encasement of the electronic equipment 100, and includes the cushioning material SJ configured to be in contact with the electronic equipment 100 encased in the packing box 2 and configured to absorb external stress applied to the electronic equipment 100, wherein the cushioning material SJ includes the plurality of cushioning sheets J-A stacked in the +Ys direction intersecting with the −Zs direction, wherein the −Zs direction is a direction in which the electronic equipment 100 is put into the packing box 2.

Therefore, as compared with a structure in which the cushioning sheets J-A are stacked in the Zs direction, the present embodiment reduces the possibility that the cushioning sheet J-A might come off of the cushioning material SJ.

Moreover, in the packing material according to the present embodiment, the cushioning sheet J-A has the sloped surface SL-A at its +Zs-side end opposite of its −Zs-side end.

Therefore, the present embodiment reduces the possibility that the electronic equipment 100 might get stuck on the +Zs-side end of the cushioning sheet J-A.

In the packing material according to the present embodiment, the cushioning material SJ comprises the holder H and the cushioning block RJ1. The holder H includes the plate member P1-A having the opening K1-A and configured to face the electronic equipment 100 when the cushioning material SJ and the electronic equipment 100 are encased in the packing box 2, and the plate member P1-B having the opening K1-B and configured to face an inner wall surface of the packing box 2 when the cushioning material SJ and the electronic equipment 100 are encased in the packing box 2. The cushioning block RJ1 is held by the holder H between the plate member P1-A and the plate member P1-B, the cushioning block RJ1 having a structure including the plurality of cushioning sheets J-A. The cushioning block R1 includes the cushioning portion QJ-A protruding through the opening K1-A in the +Xs direction going from the plate member P1-A toward the electronic equipment 100 and configured to be in contact with the electronic equipment 100, the cushioning portion QJ-B protruding through the opening K1-B in the −Xs direction going from the plate member P1-B toward the inner wall surface of the packing box 2 and configured to be in contact with the inner wall surface of the packing box 2, and the link portion Q-C provided between the plate member P1-A and the plate member P1-B and linking the cushioning portion QJ-A and the cushioning portion QJ-B to each other. The link portion Q-C is longer than the opening K1-A and the opening K1-B in the +Zs direction intersecting with the +Xs direction and the −Xs direction.

Therefore, in the present embodiment, it is possible to prevent the cushioning block RJ1 from coming off through the opening K1-A in the +Xs direction, and to prevent the cushioning block RJ1 from coming off through the opening K1-B in the −Xs direction. Moreover, in the present embodiment, it is possible to hold the cushioning block RJ1 by the holder H between the plate member P1-A and the plate member P1-B.

In the present embodiment, the holder H includes the plate member P1-C linking the plate member P1-A and the plate member P1-B to each other, and a width of the cushioning block RJ1 is greater than a width of the plate member P1-C in the +Xs direction.

Therefore, in the present embodiment, even if external stress is applied to the packing box 2, it is possible to absorb the external stress by the cushioning block RJ1, thereby softening the external force transmitted to the electronic equipment 100.

In the present embodiment, the cushioning material SJ further comprises the cushioning block Rh1. The holder H further includes the plate member Ph-A having the opening Kh1-A and configured to face the electronic equipment 100 when the cushioning material SJ and the electronic equipment 100 are encased in the packing box 2, and the plate member Ph-B having the opening Kh1-B and configured to face an inner wall surface of the packing box 2 when the cushioning material SJ and the electronic equipment 100 are encased in the packing box 2. The cushioning block Rh1 includes the cushioning portion Qh-A protruding through the opening Kh1-A in the +Zs direction going from the plate member Ph-A toward the electronic equipment 100 and configured to be in contact with the electronic equipment 100, the cushioning portion Qh-B protruding through the opening Kh1-B in the −Zs direction going from the plate member Ph-B toward the inner wall surface of the packing box 2 and configured to be in contact with the inner wall surface of the packing box 2, and the link portion Qh-C provided between the plate member Ph-A and the plate member Ph-B and linking the cushioning portion Qh-A and the cushioning portion Qh-B to each other. The link portion Qh-C is longer than the opening Kh1-A and the opening Kh1-B in the +Xs direction intersecting with the +Zs direction and the −Zs direction. Either one of the length LQ-A of the cushioning portion QJ-A in the +Zs direction and the length LQ-B of the cushioning portion QJ-B in the +Zs direction is, or both are, greater than the length HK-A of the opening Kh1-A in the +Xs direction and greater than the length HK-B of the opening Kh1-B in the +Xs direction.

Therefore, in the present embodiment, it is possible to prevent the cushioning block RJ1 from being mistakenly provided between the plate member Ph-A and the plate member Ph-B where the cushioning block Rh1 is supposed to be provided. That is, in the present embodiment, it is possible to prevent the occurrence of a mix-up of the cushioning block RJ1 with the cushioning block Rh1 when the cushioning material SJ is manufactured.

In the present embodiment, the cushioning material SJ further comprises the cushioning block Rh1. The holder H further includes the plate member P1-C linking the plate member P1-A and the plate member P1-B to each other, the plate member Ph-A having the opening Kh1-A and configured to face the electronic equipment 100 when the cushioning material SJ and the electronic equipment 100 are encased in the packing box 2, and the plate member Ph-B having the opening Kh1-B and configured to face an inner wall surface of the packing box 2 when the cushioning material SJ and the electronic equipment 100 are encased in the packing box 2. The cushioning block Rh1 includes the cushioning portion Qh-A protruding through the opening Kh1-A in the +Zs direction going from the plate member Ph-A toward the electronic equipment 100 and configured to be in contact with the electronic equipment 100, the cushioning portion Qh-B protruding through the opening Kh1-B in the −Zs direction going from the plate member Ph-B toward the inner wall surface of the packing box 2 and configured to be in contact with the inner wall surface of the packing box 2, and the link portion Qh-C provided between the plate member Ph-A and the plate member Ph-B and linking the cushioning portion Qh-A and the cushioning portion Qh-B to each other. The link portion Qh-C is longer than the opening Kh1-A and the opening Kh1-B in the +Xs direction intersecting with the +Zs direction and the −Zs direction. Either one of the length HQ-At2 from the +Xs-side end of the link portion Qh-C to the opening Kh1-A in the +Xs direction and the length HQ-Bt2 from the +Xs-side end of the link portion Qh-C to the opening Kh1-B in the +Xs direction is, or both are, greater than the length LQ-At from the plate member P1-C to the opening K1-A in the +Zs direction and greater than the length LQ-Bt from the plate member P1-C to the opening K1-B in the +Zs direction.

Therefore, in the present embodiment, it is possible to prevent the cushioning block Rh1 from being mistakenly provided between the plate member P1-A and the plate member P1-B where the cushioning block RJ1 is supposed to be provided. That is, in the present embodiment, it is possible to prevent the occurrence of a mix-up of the cushioning block Rh1 with the cushioning block RJ1 when the cushioning material SJ is manufactured.

3. Modification Examples

The exemplary embodiments described above can be modified in various ways. Some specific examples of modification are described below. Any two or more modification examples selected from among the examples described below may be combined as long as they are not contradictory to each other or one another. In each modification example described below, the same reference numerals as those used in the description and illustration of the foregoing embodiments will be assigned to elements that are equivalent to those in the foregoing embodiments in terms of operation and/or function, and a detailed explanation of them is omitted.

3.1. Modification Example 1

In the second embodiment described above, the cushioning block RJ includes the cushioning portion QJ-A made up of the plurality of cushioning sheets J-A, the cushioning portion QJ-B made up of the plurality of cushioning sheets J-B, and the link portion Q-C. However, the scope of the present disclosure is not limited to such an exemplary structure. That is, it is sufficient as long as the cushioning block RJ includes at least the cushioning portion QJ-A. For example, the cushioning block RJ may include the cushioning portion Q-B in place of the cushioning portion QJ-B.

3.2. Modification Example 2

In the first and second embodiments and the modification example 1 described above, the Xw axis, the Yw axis, and the Zw axis of the packing box coordinate system EW are orthogonal to one another. However, the scope of the present disclosure is not limited to such an exemplary structure. It is sufficient as long as the Xw axis, the Yw axis, and the Zw axis of the packing box coordinate system EW extend in directions different from one another.

In the first and second embodiments and the modification example 1 described above, the Xs axis, the Ys axis, and the Zs axis of the cushioning material coordinate system ΣS are orthogonal to one another. However, the scope of the present disclosure is not limited to such an exemplary structure. It is sufficient as long as the Xs axis, the Ys axis, and the Zs axis of the cushioning material coordinate system ΣS extend in directions different from one another.

3.3. Modification Example 3

In the first and second embodiments and the modification examples 1 and 2 described above, a case where the packing material includes four pieces of cushioning material S or cushioning material SJ has been taken as an example. However, the scope of the present disclosure is not limited to such an exemplary structure. The packing material according to the present disclosure may include one or more, but three or less, pieces of cushioning material S or cushioning material SJ. Alternatively, the packing material according to the present disclosure may include five pieces of cushioning material S or cushioning material SJ, or more.

What is claimed is:

1. A cushioning material for being put into a packing box configured for encasement of electronic equipment, the cushioning material being configured to absorb external stress applied to the electronic equipment encased in the packing box, the cushioning material comprising:

a holder including a first plate having a first opening and configured to face the electronic equipment when the cushioning material and the electronic equipment are encased in the packing box, and a second plate having a second opening and configured to face an inner wall surface of the packing box when the cushioning material and the electronic equipment are encased in the packing box; and a first cushioning block held by the holder between the first plate and the second plate, the first cushioning block including a first cushioning portion protruding through the first opening in a first direction going from the first plate toward the electronic equipment and configured to be in contact with the electronic equipment, a second cushioning portion protruding through the second opening in a second direction going from the second plate toward the inner wall surface of the packing box and configured to be in contact with the inner wall surface of the packing box, and a first link portion provided between the first plate and the second plate and linking the first cushioning portion and the second cushioning portion to each other, wherein the first link portion is longer than the first opening and the second opening, and each of the first cushioning portion and the second cushioning portion, in a first holding direction intersecting with the first direction and the second direction.

2. The cushioning material according to claim 1, wherein the holder further includes a first link plate linking the first plate and the second plate to each other, and a width of the first cushioning block is greater than a width of the first link plate in the first direction.

3. The cushioning material according to claim 1, further comprising:

a second cushioning block; wherein the holder further includes a third plate having a third opening and configured to face the electronic equipment when the cushioning material and the electronic equipment are encased in the packing box, and a fourth plate having a fourth opening and configured to face an inner wall surface of the packing box when the cushioning material and the electronic equipment are encased in the packing box; and the second cushioning block includes a third cushioning portion protruding through the third opening in a third direction going from the third plate toward the electronic equipment and configured to be in contact with the electronic equipment, a fourth cushioning portion protruding through the fourth opening in a fourth direction going from the fourth plate toward the inner wall surface of the packing box and configured to be in contact with the inner wall surface of the packing box, and a second link portion provided between the third plate and the fourth plate and linking the third cushioning portion and the fourth cushioning portion to each other, wherein the second link portion is longer than the third opening and the fourth opening in a second holding direction intersecting with the third direction and the fourth direction, and either one of a length of the first cushioning portion in the first holding direction and a length of the second cushioning portion in the first holding direction is, or both are, greater than a length of the third opening in the second holding direction and greater than a length of the fourth opening in the second holding direction.

4. The cushioning material according to claim 1, further comprising:

a second cushioning block; wherein the holder further includes a first link plate linking the first plate and the second plate to each other, a third plate having a third opening and configured to face the electronic equipment when the cushioning material and the electronic equipment are encased in the packing box, and a fourth plate having a fourth opening and configured to face an inner wall surface of the packing box when the cushioning material and the electronic equipment are encased in the packing box; and the second cushioning block includes a third cushioning portion protruding through the third opening in a third direction going from the third plate toward the electronic equipment and configured to be in contact with the electronic equipment, a fourth cushioning portion protruding through the fourth opening in a fourth direction going from the fourth plate toward the inner wall surface of the packing box and configured to be in contact with the inner wall surface of the packing box, and a second link portion provided between the third plate and the fourth plate and linking the third cushioning portion and the fourth cushioning portion to each other, wherein the second link portion is longer than the third opening and the fourth opening in a second holding direction intersecting with the third direction and the fourth direction, and either one of a length, in the second holding direction, from an end of the second link portion in the second holding direction to the third opening and a length, in the second holding direction, from the end of the second link portion in the second holding direction to the fourth opening is, or both are, greater than a length from the first link plate to the first opening in the first holding direction and greater than a length from the first link plate to the second opening in the first holding direction.

5. A packing material, comprising:

a packing box configured for encasement of electronic equipment; and a cushioning material configured to absorb external stress applied to the electronic equipment encased in the packing box, the cushioning material including a holder including a first plate having a first opening and configured to face the electronic equipment when the cushioning material and the electronic equipment are encased in the packing box, and a second plate having a second opening and configured to face an inner wall surface of the packing box when the cushioning material and the electronic equipment are encased in the packing box; and a first cushioning block held by the holder between the first plate and the second plate, the first cushioning block including a first cushioning portion protruding through the first opening in a first direction going from the first plate toward the electronic equipment and configured to be in contact with the electronic equipment, a second cushioning portion protruding through the second opening in a second direction going from the second plate toward the inner wall surface of the packing box and configured to be in contact with the inner wall surface of the packing box, and a first link portion provided between the first plate and the second plate and linking the first cushioning portion and the second cushioning portion to each other, wherein the first link portion is longer than the first opening and the second opening, and each of the first cushioning portion and the second cushioning portion, in a first holding direction intersecting with the first direction and the second direction.

6. Packed goods, comprising:

electronic equipment;

a packing box configured for encasement of the electronic equipment; and a cushioning material configured to absorb external stress applied to the electronic equipment encased in the packing box, the cushioning material including a holder including a first plate having a first opening and configured to face the electronic equipment when the cushioning material and the electronic equipment are encased in the packing box, and a second plate having a second opening and configured to face an inner wall surface of the packing box when the cushioning material and the electronic equipment are encased in the packing box; and a first cushioning block held by the holder between the first plate and the second plate, the first cushioning block including a first cushioning portion protruding through the first opening in a first direction going from the first plate toward the electronic equipment and configured to be in contact with the electronic equipment, a second cushioning portion protruding through the second opening in a second direction going from the second plate toward the inner wall surface of the packing box and configured to be in contact with the inner wall surface of the packing box, and a first link portion provided between the first plate and the second plate and linking the first cushioning portion and the second cushioning portion to each other, wherein the first link portion is longer than the first opening and the second opening, and each of the first cushioning portion and the second cushioning portion, in a first holding direction intersecting with the first direction and the second direction.

* * * * *